US012319493B2

(12) United States Patent
Zacharia et al.

(10) Patent No.: US 12,319,493 B2
(45) Date of Patent: Jun. 3, 2025

(54) COLLAPSIBLE SHIPPING CONTAINER

(71) Applicant: Crowley Government Services, Inc., Jacksonville, FL (US)

(72) Inventors: Shiju Zacharia, Jacksonville, FL (US); Smijith Kunhiraman, Jacksonville, FL (US); Patrick Wallace, St. Augustine, FL (US); Ashwani Dev, Katy, TX (US)

(73) Assignee: Crowley Government Services, Inc., Jacksonville, FL (US)

( * ) Notice: Subject to any disclaimer, the term of this patent is extended or adjusted under 35 U.S.C. 154(b) by 557 days.

(21) Appl. No.: 17/538,063

(22) Filed: Nov. 30, 2021

(65) Prior Publication Data

US 2022/0169440 A1 Jun. 2, 2022

Related U.S. Application Data

(60) Provisional application No. 63/119,969, filed on Dec. 1, 2020.

(51) Int. Cl.

| | |
|---|---|
| ***B65D 88/52*** | (2006.01) |
| ***B65D 21/02*** | (2006.01) |
| ***B65D 21/08*** | (2006.01) |
| ***B65D 88/02*** | (2006.01) |
| ***B65D 90/00*** | (2006.01) |
| *B65D 88/12* | (2006.01) |

(52) U.S. Cl.

CPC ..... *B65D 88/524* (2013.01); *B65D 21/0209* (2013.01); *B65D 21/086* (2013.01); *B65D 88/022* (2013.01); *B65D 90/0033* (2013.01); *B65D 88/121* (2013.01); *B65D 2519/00905* (2013.01); *B65D 2519/0096* (2013.01)

(58) Field of Classification Search

CPC ..... B65D 21/0209; B65D 21/086

See application file for complete search history.

(56) References Cited

U.S. PATENT DOCUMENTS

| | | | |
|---|---|---|---|
| 962,429 | A | 6/1910 | Hedden |
| 2,936,090 | A | 5/1960 | Caldwell |

(Continued)

FOREIGN PATENT DOCUMENTS

| | | | |
|---|---|---|---|
| CN | 208119633 | U | 11/2018 |
| CN | 210338809 | U | 4/2020 |
| JP | 2002-114223 | A | 4/2002 |

OTHER PUBLICATIONS

Anonymous, "Collapsible, Returnable Crates", American Fruit Grower; Aug. 1999, 119, 8; ProQuest, p. S12.

(Continued)

*Primary Examiner* — Don M Anderson

(74) *Attorney, Agent, or Firm* — Michele V. Frank; Venable LLP

(57) ABSTRACT

A collapsible container that includes a base, a first side panel hingedly attached to the base, a second side panel hingedly attached to the base, a first end panel hingedly attached to the base, with the first end panel including a door, and a second end panel hingedly attached to the base. The collapsible container can further include a top cover. The collapsible container is configured to be positioned in a collapsed position and an assembled position. In an assembled position, the collapsible container is configured to hold items during a domestic or international move.

37 Claims, 25 Drawing Sheets

(56) References Cited

U.S. PATENT DOCUMENTS

| | | | | |
|---|---|---|---|---|
| 2,972,430 | A | 2/1961 | Johnson | |
| 3,040,925 | A | 6/1962 | Mills | |
| 3,398,850 | A | 8/1968 | Kennard | |
| 3,563,403 | A | 2/1971 | Luisada et al. | |
| 3,635,368 | A | 1/1972 | Winsor | |
| 4,214,669 | A | 7/1980 | McQuinston | |
| 4,674,647 | A | 6/1987 | Gyenge et al. | |
| 4,742,653 | A | 5/1988 | Napier et al. | |
| 5,031,794 | A * | 7/1991 | Wezenberg | F16B 21/078 403/325 |
| 5,056,667 | A | 10/1991 | Coogan | |
| 5,289,933 | A | 3/1994 | Streich et al. | |
| 5,467,885 | A | 11/1995 | Blinstrub | |
| 5,501,354 | A * | 3/1996 | Stromberg | B65D 1/225 220/7 |
| 5,595,305 | A | 1/1997 | Hart | |
| 6,006,918 | A | 12/1999 | Hart | |
| 6,401,953 | B2 | 6/2002 | Kofod | |
| 6,422,409 | B2 | 6/2002 | Kofod | |
| 6,726,046 | B2 | 4/2004 | Orset | |
| 6,811,048 | B2 | 11/2004 | Lau | |
| 6,877,628 | B2 | 4/2005 | Nesting | |
| 6,981,605 | B2 | 1/2006 | Kasuya et al. | |
| D546,023 | S | 7/2007 | Hawes | |
| 7,296,704 | B2 | 11/2007 | Ferrini | |
| 8,181,806 | B2 * | 5/2012 | Hidalgo Vargas | B65D 11/1833 220/4.28 |
| 8,292,107 | B1 | 10/2012 | Hong | |
| 8,408,412 | B2 | 4/2013 | Hong | |
| 8,757,412 | B2 | 6/2014 | Sommer et al. | |
| 8,960,468 | B2 | 2/2015 | Boivin | |
| 9,440,786 | B2 | 9/2016 | Giesbers et al. | |
| 9,815,615 | B2 | 11/2017 | Doolittle | |
| 9,896,263 | B2 | 2/2018 | Leong | |
| D873,524 | S | 1/2020 | Applegate et al. | |
| 2002/0047041 | A1 * | 4/2002 | O'Connell | B65D 5/12 229/125.21 |
| 2003/0049089 | A1 * | 3/2003 | Yeomans | B65D 88/12 410/32 |
| 2007/0108204 | A1 | 5/2007 | Warhurst et al. | |
| 2009/0026196 | A1 | 1/2009 | Leedekerken | |
| 2011/0062167 | A1 | 3/2011 | Colton et al. | |
| 2012/0006816 | A1 * | 1/2012 | Turnquist | B65D 90/008 49/394 |
| 2012/0248105 | A1 | 10/2012 | Leong | |
| 2014/0224795 | A1 * | 8/2014 | Parnall | B65D 19/38 220/7 |
| 2014/0238979 | A1 | 8/2014 | Chen | |
| 2015/0108139 | A1 * | 4/2015 | Skeid | B65D 90/24 220/571 |
| 2017/0129695 | A1 * | 5/2017 | Utz | B65D 88/524 |
| 2018/0194553 | A1 * | 7/2018 | Jian | B65D 90/626 |
| 2019/0053618 | A1 | 2/2019 | Kindred, Jr. | |
| 2019/0241314 | A1 | 8/2019 | Pawluk | |
| 2019/0270545 | A1 | 9/2019 | Apps et al. | |
| 2019/0276226 | A1 * | 9/2019 | Havener | B65D 88/528 |
| 2020/0087059 | A1 | 3/2020 | Kim et al. | |

OTHER PUBLICATIONS

Rob Konings, "Foldable Containers to Reduce the Costs of Empty Transport? A Cost-Benefit Analysis from a Chair and Multi-Actor Perspective", Maritime Economics & Logistics, 2005, 7, Delft University of Technology (The Netherlands), pp. 223-249.

Instablogs, "Cargoshell demonstrates collapsible shipping containers to reduce emissions," Athena Information Solutions, Shimla, India, Feb. 8, 2010.

Miller, John W., "Containing container costs—Shippers could save fuel, space with a new model, but they are waiting for proof it works," Wall Street Journal, Europe; Brussels, Apr. 12, 2010.

Miller, John W., "Foldable Shipping Containers Try to Stack Up," Dow Jones Institutional News, New York, Apr. 11, 2010.

Hanlon, Mike, "The Cargoshell: ingenious collapsible replacement for the standard shipping container" Jan. 6, 2010 (14 pages).

Collapsible Storage Bin with Lid—CleverMade, https://www.clevermade.com/products/clevercrate-storage-bin-with-lid (9 pages)(originally downloaded on Feb. 2020).

"The Collapsible Cargoshell Shipping Container Concept Waits for ISO Certification," MI News Network, Dec. 23, 2019 (5 pages).

International Search Report and Written Opinion mailed Apr. 21, 2022, directed to International Application No. PCT/US2021/061125; 16 pages.

* cited by examiner

Table 1:Properties of material

| | Density (kg/m3) | Elastic Modulus (GPa) | Poisson ratio |
|---|---|---|---|
| Plywood | 520 | 8.6 | 0.22 |
| Plastic (polypropylene) | 920 | 2 | 0.36 |
| Carbon fiber/epoxy composite | 1590 | 220 | 0.25 |

Table 2: Varied parameters

| Variables | Minimum | Maximum |
|---|---|---|
| Base thickness | 0.05in | 0.05in |
| Support thickness | 2in | 2.5in |

Table 3: Optimal results

| Materials | Base thickness | Support thickness | Factor of safety | Deformation | Weight |
|---|---|---|---|---|---|
| Wood | 0.35in | 2in | 3 | 2.4mm | 62.28lb |
| Polypropylene | 0.5in | 2in | 4.9 | 6.1mm | 135.7lb |
| Composite | 0.1in | 2in | 3.8 | 1.8mm | 116.78 |

FIG. 32

COLLAPSIBLE SHIPPING CONTAINER

CROSS-REFERENCE TO RELATED APPLICATIONS

This application claims priority to U.S. Provisional Application No. 63/119,969 filed Dec. 1, 2020, the entire contents of which is hereby incorporated by reference.

TECHNICAL FIELD

The present invention relates to a collapsible shipping container for holding items during a domestic or international move. The collapsible shipping container is stackable when empty for storage and/or transport.

BACKGROUND

Generally, when an individual or family is moving domestically, cardboard moving boxes, as well as a moving van or truck, are often used to hold and transport the person's furniture, household goods, and other personal belongings. These moving boxes are commonly made of cardboard and thus, are susceptible to wear and damage.

For an international move, liftvans or shipping containers are commonly used to hold and transport a person's personal effects. For a smaller shipment, e.g., less than 850 cubic feet, a liftvan is generally used. A liftvan is a plywood crate that is specifically made of a certain size to ship various items internationally. These liftvans are usually expensive to produce and thereafter, have to be stored and/or broken down after use and/or damage. Additionally, these liftvans are susceptible to water damage, as well as other types of damage and/or loss.

There is therefore a need for an improved shipping container that can effective store and transport items for both domestic and international moves that is easy to assemble and disassemble, while also being reusable and storable.

BRIEF SUMMARY OF THE INVENTION

According to one embodiment, the present invention provides a collapsible container that includes a base, a first side panel hingedly attached to the base, a second side panel hingedly attached to the base, a first end panel hingedly attached to the base, with the first end panel including a door, and a second end panel hingedly attached to the base. The collapsible container is configured to be positioned in a collapsed position and an assembled position, such that, in the collapsed position, the second end panel is positioned on top of the second side panel, the second side panel is positioned on top of the first side panel, the first side panel is positioned on top of the first end panel, and the first end panel is positioned on top of the base.

According to an embodiment, in the assembled position, (a) the first end panel attaches to (i) the first side panel along a first side of the first end panel and (ii) the second side panel along a second side of the first end panel, and (b) the second end panel attaches to (i) the first side panel along a first side of the second end panel and (ii) the second side panel along a second side of the second end panel, such that the first end panel is disposed opposite to the second end panel and the first side panel is disposed opposite to the second side panel. According to an embodiment, in the assembled position, the first end panel (and/or the second end panel) attaches to each of the first side panel and the second side panel using a notched design along each of the first side and the second side of the first end panel (and/or the second end panel). According to another embodiment, in the assembled position, the first end panel (and/or the second end panel) further attaches to each of the first side panel and the second side panel using an internal latching mechanism. According to embodiment, the internal latching mechanism comprises (i) a locking pin configured to be positioned within a plastic bar that is disposed on an interior surface of the first end panel (and/or the second end panel), or (ii) a pin configured to be positioned within a piano hinge installed on an interior surface of at least the second end panel.

According to an embodiment, the collapsible container further includes a top cover. According to an embodiment, in the collapsed position, the top cover is positioned on top of the second end panel. According to another embodiment, in the assembled position, the top cover attaches to a top edge of the first side panel and a top edge of the second side panel with an internal latching mechanism. According to an embodiment, the internal latching mechanism comprises a plurality of locking pins configured to be positioned within respective plastic bars disposed on an interior surface of the top cover. According to an embodiment, in the collapsed position, the top cover attaches to the base with an internal latching mechanism.

According to an embodiment, the collapsible container further includes a top cover. According to an embodiment, the top cover includes an arched edge configured to provide for water drainage. According to an embodiment, the top cover comprises a plastic material. According to another embodiment, the top cover comprises a corrugated plastic material. According to an embodiment, the top cover includes strap points configured to support straps to secure the top cover to the collapsible container.

According to an embodiment, each of the first side panel and the second side panel includes an internal hinge mechanism along a mid-point of the respective side panel, such that each of the first side panel and the second side panel is configured to fold in half along this internal hinge mechanism.

According to an embodiment, at least one of the first side panel and the second side panel comprises a corrugated plastic material.

According to an embodiment, each of the base, the first and second side panels, and the first and second end panels comprises a plastic material, such as, e.g., polypropylene.

According to an embodiment, one or more of the base, the first and second side panels, and the first and second end panels of the collapsible container are manufactured by at least one of (i) 3D printing technology, (ii) conventional plastic molding methods, (iii) manufacturing methods using materials that can be derived from recycled waste material, or (iv) a combination of (i), (ii), and/or (iii).

According to an embodiment, the door is attached to the first end panel using a hinge mechanism. According to an embodiment, in the assembled position, the door is configured to be locked using a sealing mechanism.

According to an embodiment, the container provides 240 cubic feet of interior space in the assembled position. According to an embodiment, in the collapsed position, the container has dimensions of 90 inches in length, 48 inches to 57 inches in width, and 8 inches to 14 inches in height. According to an embodiment, in the assembled position, the container has dimensions of 90 inches in length, 57 inches in width, and 90 inches in height. According to an embodiment, iii the assembled position, the container has dimensions of 90 inches in length, 48 inches in width, and 84 inches in height.

According to an embodiment, the container only comprises plastic and metal parts.

According to an embodiment, the container is only assembled with a plurality of hinges and a plurality of latching mechanisms (e.g., lock pins). According to an embodiment, the container does not require any spare parts, bolts, nails, screws or other attaching means.

According to an embodiment, the container is water resistant.

According to an embodiment, the container further comprises a means for tracking the container during transport. According to an embodiment, the means for tracking comprises a barcode, an RFID tag, a sensor, a pallet tracker a GPS or BLUETOOTH® enabled tracker) Or a combination thereof.

According to an embodiment, at least one of the first side panel, the second side panel, the first end panel, and the second end panel includes an internal pin configured to hold the respective panel in an upright position.

According to another embodiment, the present invention provides a method of assembling a collapsible container that includes (a) providing a collapsible container that includes (i) a base, (ii) a first side panel hingedly attached to the base, (iii) a second side panel hingedly attached to the base, (iv) a first end panel hingedly attached to the base, and (v) a second end panel hingedly attached to the base, (b) lifting the second end panel to an upright position, (c) lifting the second side panel to an upright position, (d) attaching the second side panel to the second end panel, (e) lifting the first side panel to an upright position, (f) attaching the first side panel to the second end panel, (g) lifting the first end panel to an upright position, and (h) attaching the first end panel to both the first side panel and the second side panel.

According to an embodiment, the first end panel attaches to each of the first side panel and the second side panel using a notched design along each of a first side and a second side of the first end panel. According to an embodiment, the first end panel further attaches to each of the first side panel and the second side pan& using an internal latching mechanism.

According to an embodiment, the second end panel attaches to each of the first side panel and the second side panel using a notched design along each of a first side and a second side of the second end panel. According to an embodiment, the second end panel further attaches to each of the first side panel and the second side panel using an internal latching mechanism.

According to an embodiment, the method further includes positioning a top cover on top of each of the first end panel, the second end panel, first side panel, and the second side panel. According to an embodiment, the top cover attaches to a top edge of the first side panel and a top edge of the second side panel with an internal latching mechanism.

According to yet another embodiment, the present invention provides a method of collapsing a collapsible container that includes (a) providing a collapsible container that includes (i) a base, (ii) a first side panel hingedly attached to the base and positioned in an upright position, (iii) a second side panel hingedly attached to the base and positioned in an upright position, (iv) a first end panel hingedly attached to the base and positioned in an upright position, and (v) a second end panel hingedly attached to the base and p an upright position, (b) folding the first end panel down, such that the first end panel is positioned on top of the base, (c) folding the first side panel down, such that the first side panel is positioned on top of the first end panel, (d) folding the second side panel dozen, such that the second side panel is positioned on top of the first side panel, and (e) folding the second end panel down, such that the second end panel is positioned on top of the second side panel.

According to an embodiment, the step of folding the first side panel down includes (a) folding the first side panel in half along a hinged mechanism provided along a mid-point of the trot side panel, and (b) folding the first side panel down along a hinged mechanism provided at the base.

According to an embodiment, the step of folding the second side panel down includes (a) folding the second side panel in half along a hinged mechanism provided along a mid-point of the second side panel and (b) folding the second side panel down along a hinged mechanism provided at the base.

According to an embodiment, the method further includes a step of removing a top cover from each of the first end panel, the second end panel, the first side panel, and the second side panel that are each positioned in the upright position. According to an embodiment, the method further includes positioning the top cover onto the collapsible container when in a collapsed position. According to an embodiment, the method further includes attaching the top cover to the base with an internal latching mechanism.

Additional features, advantages, and embodiments of the invention are set forth or apparent from consideration of the following detailed description, drawings and claims. Moreover, it is to be understood that both the foregoing summary of the invention and the following detailed description are exemplary and intended to provide further explanation with out limiting the scope of the invention as claimed.

BRIEF DESCRIPTION OF THE DRAWINGS

FIG. 32 illustrates three tables that study various materials and their properties for preparing a collapsible container according to an embodiment of the invention.

DETAILED DESCRIPTION OF THE INVENTION

Throughout the specification and claims, the following terms take the meanings explicitly associated herein, unless the context clearly dictates otherwise. The phrases "in one embodiment," "in an embodiment," and "in some embodiments" as used herein do not necessarily refer to the same embodiment(s) though they may. Furthermore the phrases "in another embodiment" and "in some other embodiments" as used herein do not necessarily refer to a different embodiment, although they may. All embodiments of the disclosure are intended to be combinable without departing from the scope or spirit of the disclosure.

As used herein, the term "based on" is not exclusive and allows for being based on additional factors not described, unless the context clearly dictates otherwise. In addition, throughout the specification, the meaning of "a," "an," and "the" include plural references. The meaning of in includes "in" and "on."

As used herein, terms such as "comprising," "including," and "having" do not limit the scope of a specific claim to the materials or steps recited by the claim.

As used herein, the term "liftvan" is defined to mean a large, strong waterproof shipping case in which household and/or other goods may be sealed and/or shipped as a unit.

The present invention relates to a collapsible shipping container and/or a liftvan for holding items during a domestic or international move. The collapsible shipping container and/or lift an is further collapsible when empty for storage and/or transport.

Accordingly, one embodiment includes a collapsible container that includes a base, a first side panel hingedly attached to the base, a second side panel hingedly attached to the base, a first end panel hingedly attached to the base, with the first end panel including a door, and a second end panel hingedly attached to the base. The collapsible container is configured to be positioned in a collapsed position and an assembled position.

Figures 1, 2:
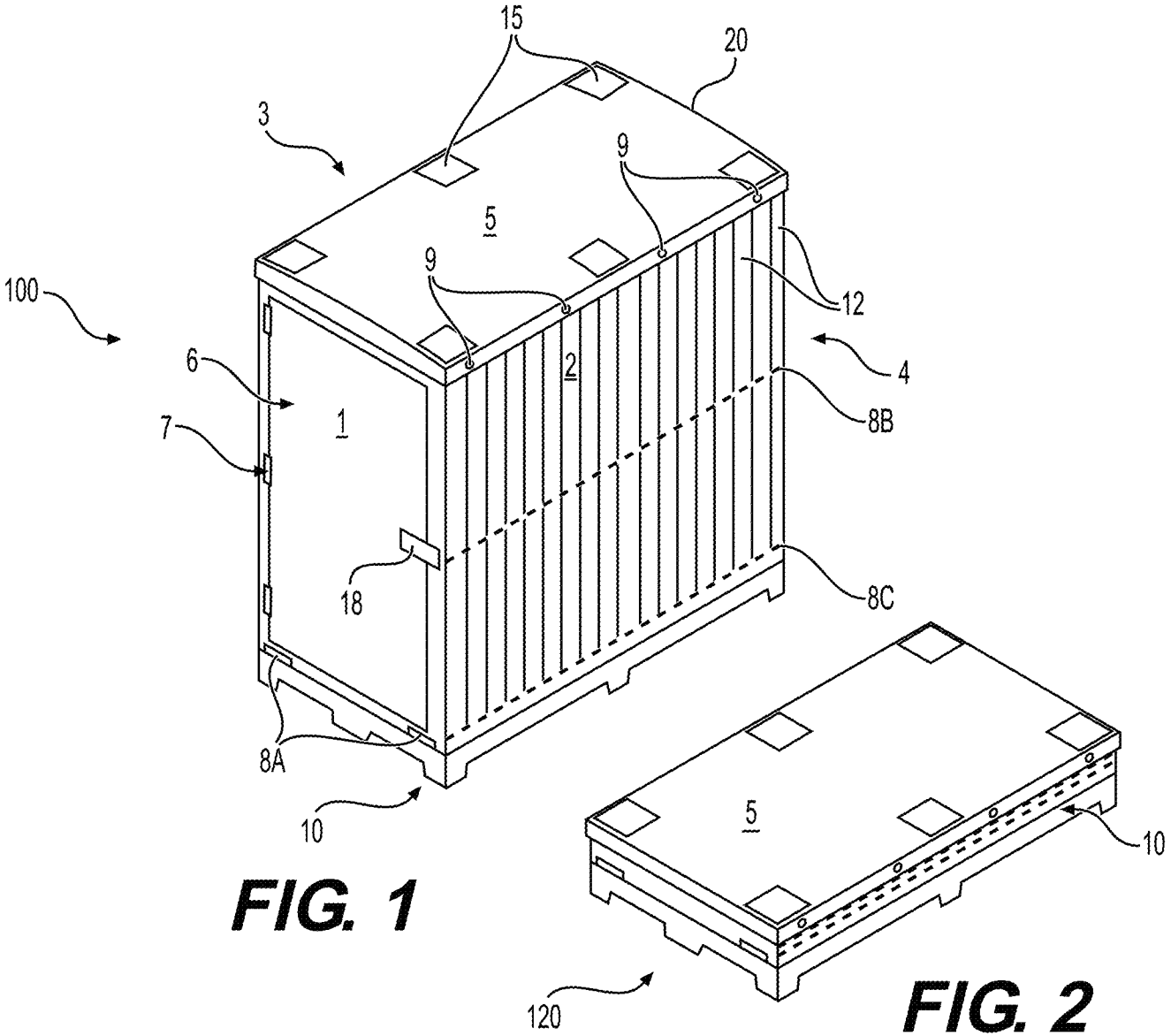
FIG. 1 illustrates a collapsible container in an assembled position according to an embodiment of the invention.
FIG. 2 illustrates the collapsible container of FIG. 1 in a collapsed position according to an embodiment of the invention.

FIG. 1 illustrates a collapsible container in an assembled position according to an embodiment of the invention. As shown in FIG. 1, the collapsible container (100) includes a base (10), a first end panel (1), a first side panel (2), a second side panel (3), and a second end panel (4). The first end panel (1) is hingedly attached to the base (10) via a hinge mechanism (e.g., a set of panel hinges (8A) that attach directly to the base (10) at the bottom edge of the first end panel (1)). The second end panel (4) is also hingedly attached to the base (10) via a hinge mechanism (not shown). The first side panel (2) is hingedly attached to the base (10) via a hinge mechanism (e.g., bottom hinge (8C) that is positioned about three inches above the base (10)). The first side panel (2) further includes a hinge mechanism (e.g., hinge (8B)) disposed along a mid-point of the first side panel (2), which allows for the first side panel (2) to fold in-half (i.e., the first side panel (2) is a bi-folding panel). Similar to the first side panel (2), the second side panel (3) is hingedly attached to the base (10) via a hinge mechanism (not shown). The second side panel (3) also includes a hinge mechanism (not shown) disposed along a mid-point of the second side panel (3), which allows for the second side panel (3) to fold in-half (i.e., the second side panel (3) is also a hi-folding panel).

As also shown in FIG. 1, the first end panel (1) includes a door (6). The door (6) is hingedly attached to the first end panel (1) via a set of hinges (7). As shown in FIG. 1 the hinges (7) that attach the door (6) to the first end panel (1) are disposed vertically along a side edge of the first end panel (1), while the set of panel hinges (8A) that attach the first end panel (1) to the base (10) are disposed horizontally along a bottom edge of the first end panel (1). The door (6) is further configured to be locked or sealed via a locking means (18) disposed along one side of the door (6) that is opposite to the set of hinges (7). This locking means (18) allows for items contained within the container (100) to be securely stored during shipping and/or transport of the container (100). The door (6) is also configured to be of a height that allows for a person to walk into and out of the container (100) during loading and unloading of the items from the container (100).

As also shown in FIG. 1, the container (100) further includes a top cover (5). The top cover (5) is configured to be positioned on top of the top edges of the first end panel (1), the first side panel (2), the second side panel (3), and the second end panel (4), when each of these panels are in the standing or upright position of FIG. 1. The top cover (5) is further configured to attach to at least the first side panel (2) and the second side panel (3) via an internal latching mechanism (9), which will be described in further detail below. The top cover (5) can include one or more arched edges (20), which allows for water to effectively drain off of the top cover (5) of the container (100). This design of the top cover (5) for water drainage allows for water resiliency, as well as protection of the items contained within the container (100) during shipping and/or transport of the container (100). The top cover (5) can further include strap points (15), which provide extra support and stability to the container (100), if the container (100) is strapped with, e.g., plastic straps via, for example, a strapping machine prior to shipping and/or transport.

According to an embodiment, each of the base (10), the first end panel (1), the first side panel (2), the second side panel (3), the second end panel (4), and the top cover (5) comprises a plastic material. By creating the base (10), the panels (1)-(4), and the top cover (5) out of a plastic material, the container (100) can be made to be water-resistant as well as durable, easier to transport, and reusable. Moreover, by creating the base (10), the panels (1)-(4), and the top cover (5) out of a plastic material, the container (100) will not be required to have an ISPM-15 treatment with international shipping and/or transport, because the plastic material will not be susceptible to various parasitic organisms that are commonly found in wood-based containers (i.e., wooden lift-vans).

Figure 29:
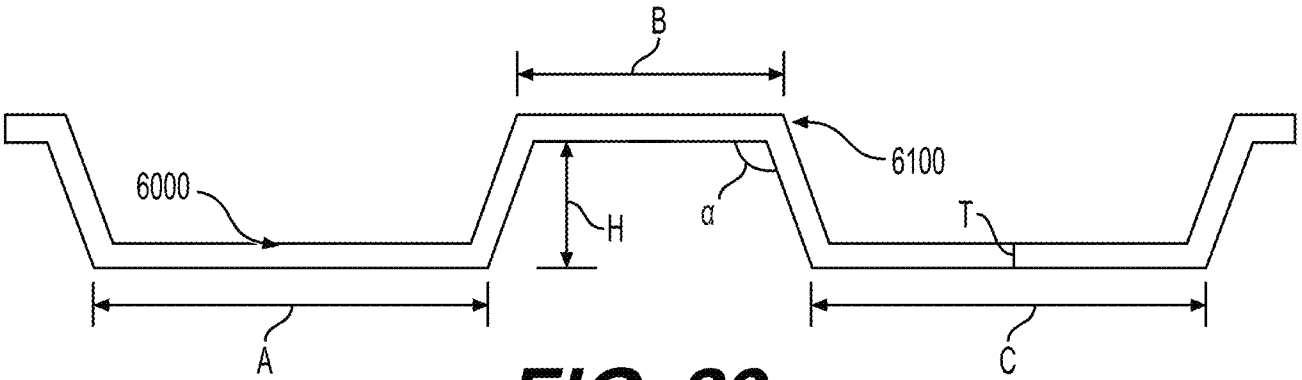
FIG. 29 illustrates a partial, exploded, top view of a corrugated panel of a collapsible container according to an embodiment of the invention.

As shown in FIG. 1, at least the first side panel (2) comprises corrugated plastic panels (12) (see also, e.g., FIG. 29). Corrugated plastic provides strength, but is less weight than a completely filled plastic panel. According to an embodiment, each of the first side panel (2), the second side panel (3), and the top cover (5) comprises corrugated plastic. However, the top cover (5) can include a heavier gauge plastic material at any strap points (15) included with the top cover (5) to provide the necessary support and stability (as discussed above). The first end panel (1) and the second end panel (4), as well as the base (10), are generally not prepared from a corrugated plastic or are prepared from less corrugated plastic than the side panels (2, 3) and the top cover (5), as these end panels (1, 4), as well as the base (10), need to be stronger than the side panels (2, 3). The base (10) generally comprises a heavy gauge plastic material to provide the strength necessary to hold the various items contained within the container (100) during shipment and/or transport.

As discussed above, the collapsible container is configured to be positioned in a collapsed position (see, e.g., FIG. 2) and an assembled position (see, e.g., FIG. 1). In the collapsed position, the second end panel is positioned on top of the second side panel, the second side panel is positioned on top of the first side panel, the first side panel is positioned on top of the first end panel, and the first end panel is positioned on top of the base. According to an embodiment, the top cover can be positioned onto the collapsible container when in a collapsed position. For example, FIG. 2 illustrates an embodiment of a collapsed container (120), which is the container (100) of FIG. 1 in a collapsed position. As shown in FIG. 2, the collapsed container (120) provides the base (10) on the bottom, the top cover (5) on top, and all of the other panels are positioned between the base (10) and the top cover (5) in a collapsed or folded position. The collapsing of the container (100) into the collapsed position (120) will be described in further detail below.

Figure 3:
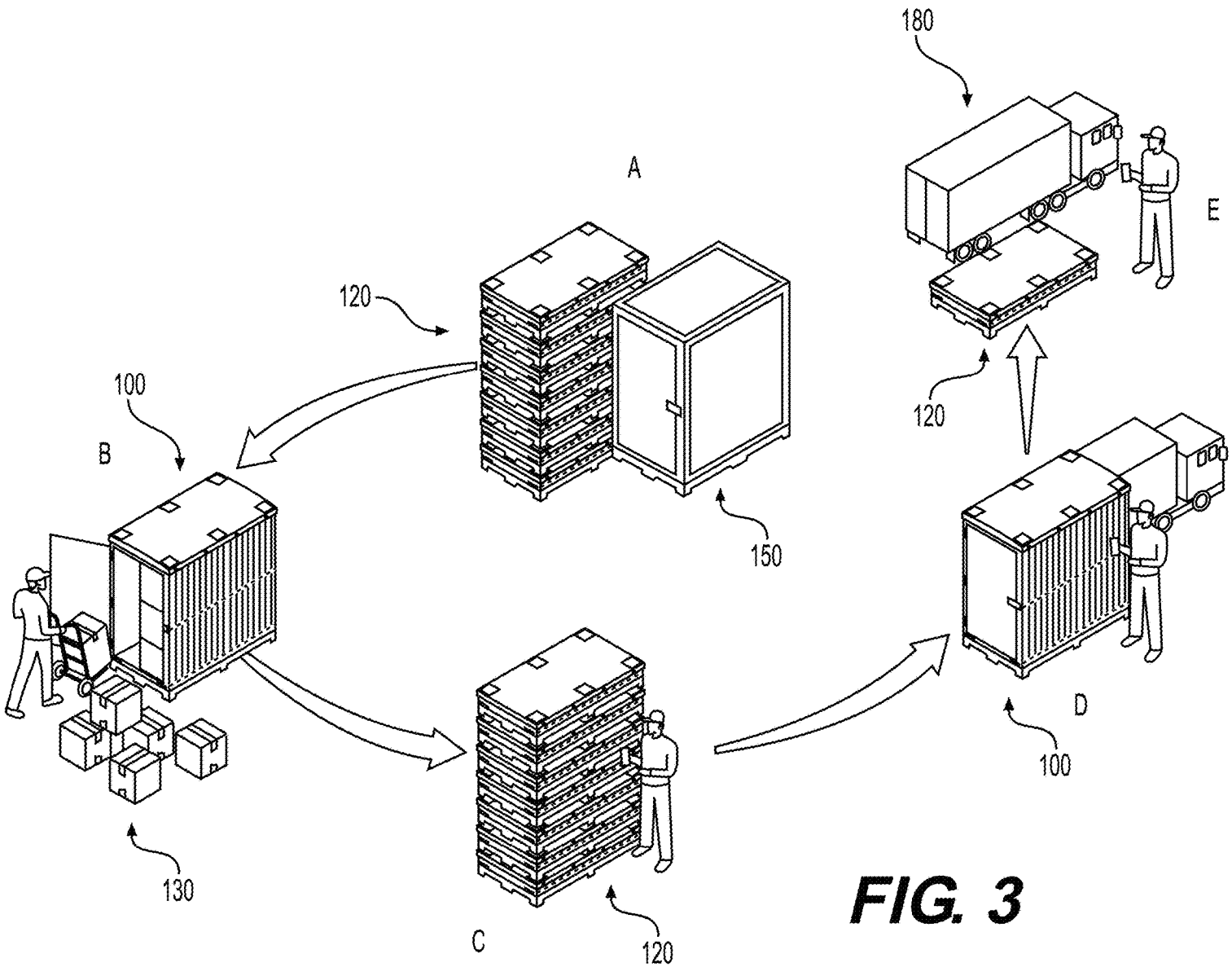
FIG. 3 is a diagram illustrating the assembly, disassembly, and transport of a collapsible container according to an embodiment of the invention.

FIG. 3 illustrates the assembly, disassembly, and transport of a collapsible container according to an embodiment of the invention. As shown in FIG. 3, a plurality of the collapsed containers (120) can be stacked on top of each other, with at least six to seven collapsed containers (120) being equivalent to the height of one conventional liftvan (150) (see step A of FIG. 3). As illustrated in this step A of FIG. 3, the collapsing of the containers allows for multiple collapsed containers (120) to be stored in a location that would normally only house or store a single conventional liftvan (150). As shown in step B of FIG. 3, during loading of items into the container, the collapsible container (100) is assembled into the assembled position (see, e.g., FIG. 1), which allows for a person to enter/exit the collapsible container (100) through the door of the first end panel (see, e.g., door (6) of FIG. 1) with boxes (130) and other items for shipment and/or transport. After loading, shipping/transport, and unloading of the boxes (130) and other items from the collapsible container (100), the container can again be collapsed into the collapsed position (see, e.g., FIG. 2), which allows for the collapsed container(s) (120) to the returned to, for example, a moving, storage or other originating company for subsequent use (see step C of FIG. 3). As shown in step D of FIG. 3, once the collapsed containers (120) are returned to, for example, a centralized location, the collapsible container (100) can be assembled into the assembled position for cleaning and/or repairs to be conducted. Finally, as shown in step E of FIG. 3, after cleaning and/or repairs are conducted, the container (100) can again be collapsed, and the collapsed container(s) (120) can be delivered via, for example, a semi-truck (180) or moving truck to a moving, storage or other originating company for subsequent use.

Figure 4:
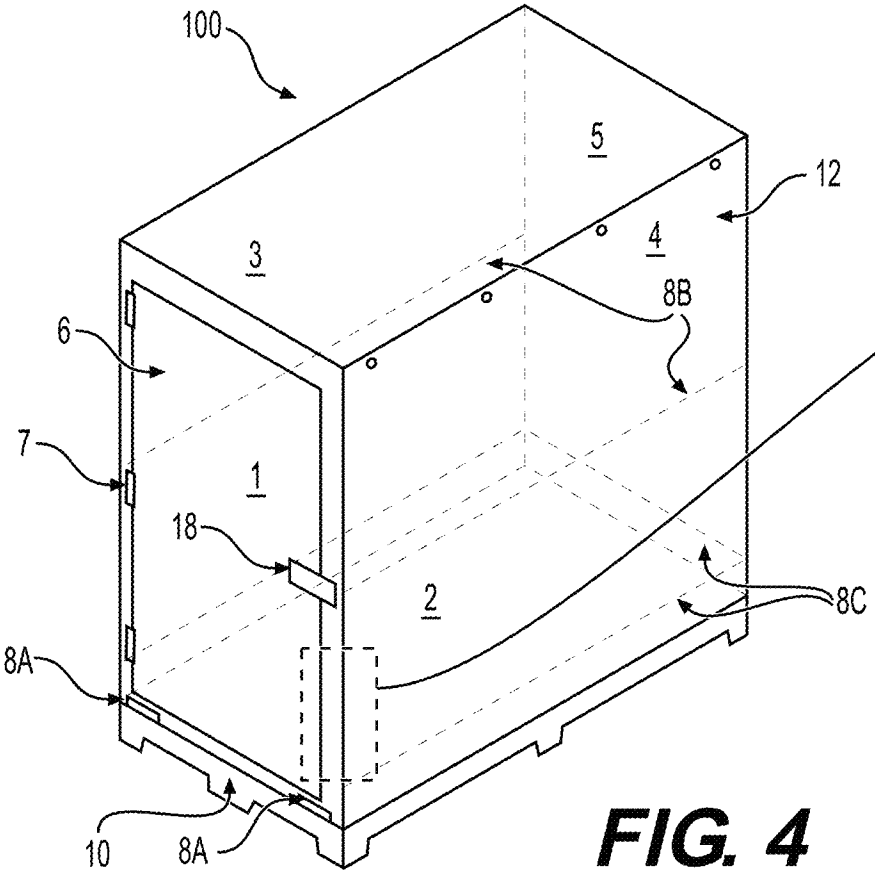
FIG. 4 illustrates a collapsible container in an assembled position according to an embodiment of the invention.

FIG. 4 illustrates a similar illustration of the collapsible container of FIG. 1 in an assembled position, with additional details, according to an embodiment of the invention. As shown in FIG. 4, the collapsible container (100) includes a base (10), a first end panel (1), a first side panel (2), a second side panel (3), and a second end panel (4). The first end panel (1) is hingedly attached to the base (10) via a hinge mechanism (e.g., a set of panel hinges (8A) that attach directly to the base (10) at the bottom edge of the first end panel (1)). The second end panel (4) is also hingedly attached to the base (10) via a hinge mechanism (e.g., bottom hinge (8C)). According to an embodiment, the bottom hinge (8C) of the second end panel (4) is generally positioned about six inches above the base (10), which allows for the configuration of the collapsed container (e.g., collapsed container (120) of FIGS. 2 and 6), which will be described in further detail below. The first side panel (2) is hingedly attached to the base (4) via a hinge mechanism (e.g., bottom hinge (8C)). According to an embodiment, the bottom hinge (8C) of the first side panel (2) is generally positioned about three inches above the base (10), which allows for the configuration of the collapsed container (e.g., collapsed container (120) of FIGS. 2 and 6), which will be described in further detail below. The first side panel (2) further includes a hinge mechanism (e.g., hinge (8B)) disposed along a mid-point of the first side panel (2), which allows for the first side panel (2) to fold in-half (i.e., the first side panel (2) is a bi-folding panel). Similar to the first side panel (2), the second side panel (3) is hingedly attached to the base (10) via a hinge mechanism (e.g., bottom hinge (8C)). According to an embodiment, the bottom hinge (8C) of the second side panel (3) is generally positioned about five inches above the base (10), which allows for the configuration of the collapsed container (e.g., collapsed container (120) of FIGS. 2 and 6), which will be described in further detail below. The second side panel (3) also includes a hinge mechanism (e.g., hinge (8B)) disposed along a mid-point of the second side panel (3), which allows for the second side panel (3) to fold in-half (i.e., the second side panel (3) is also a hi-folding panel).

As also shown in FIG. 4, the first end panel (1) includes a door (6). The door (6) is hingedly attached to the first end panel (1) via a set of hinges (7). The door (6) is further configured to be locked or sealed via a locking means (18) disposed along one side of the door (6) that is opposite to the set of hinges (7). This locking means (18) allows for items contained within the container (100) to be securely stored during shipping and/or transport of the container (100).

Figure 5:
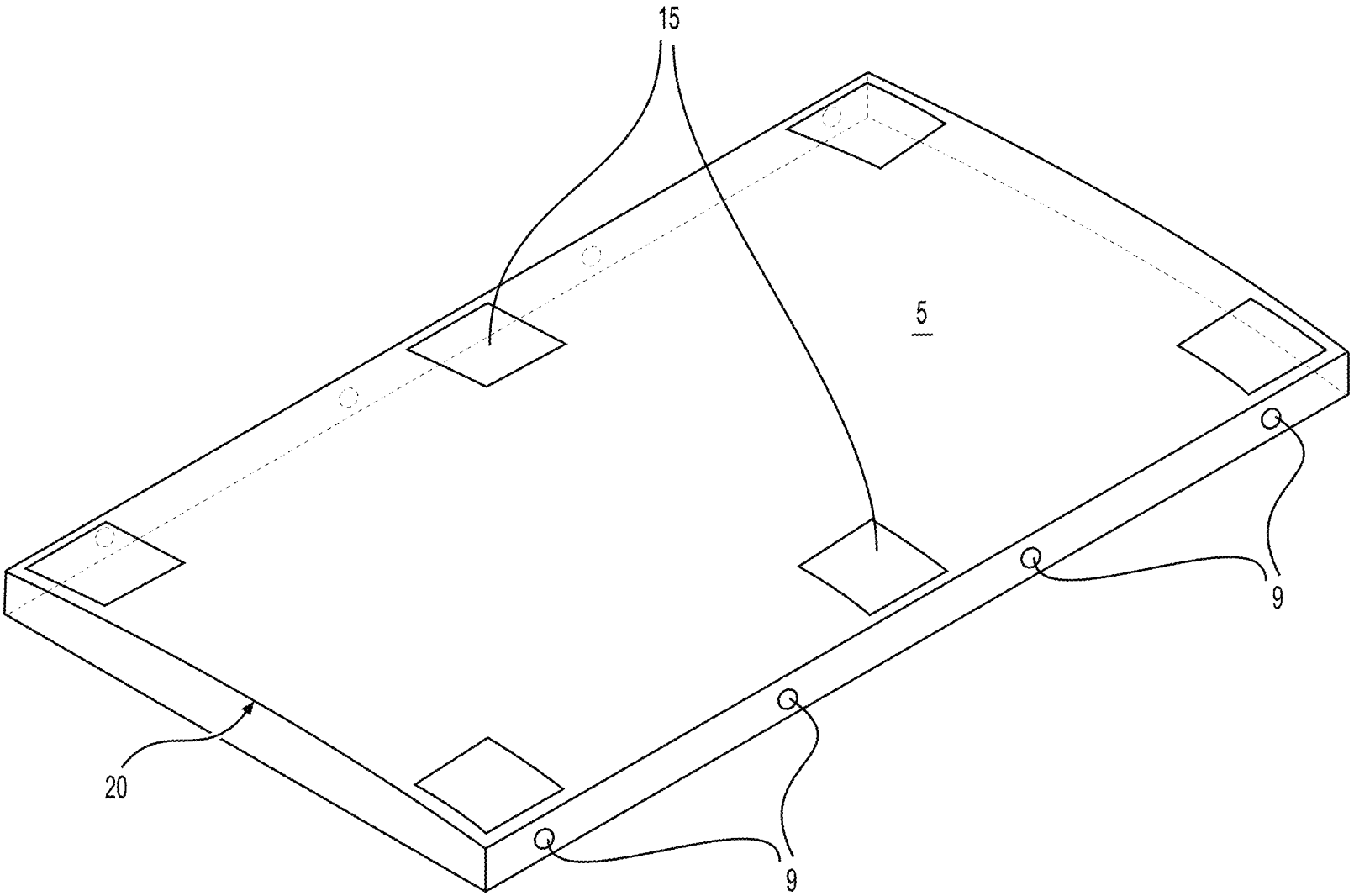
FIG. 5 illustrates a top cover or lid for a collapsible container according to an embodiment of the invention.

As also shown in FIG. 4, the container (100) further includes a top cover (5). The top cover (5) is configured to be positioned on top of the top edges of the first end panel (1), the first side panel (2), the second side panel (3), and the second end panel (4), when each of these panels are in the standing or upright position of FIG. 4. FIG. 5 illustrates a more detailed view of the top cover (5) according to an embodiment of the invention. As shown in FIG. 5, the top cover (5) includes strap points (15), which provide extra support and stability to the container (100), if the container (100) is strapped with, e.g., plastic straps via, for example, a strapping machine prior to shipping and/or transport. The top cover (5) further includes an internal latching mechanism (9) to attach the top cover (5) to at least the first side panel (2) and the second side panel (3), which will be described in further detail below. The top cover (5) can also include one or more arched edges (20), which allows for water to effectively drain off of the top cover (5) of the container (100). This design of the top cover (5) for water drainage allows for water resiliency, as well as protection of the items contained within the container (100) during shipping and/or transport of the container (100).

Figure 6:
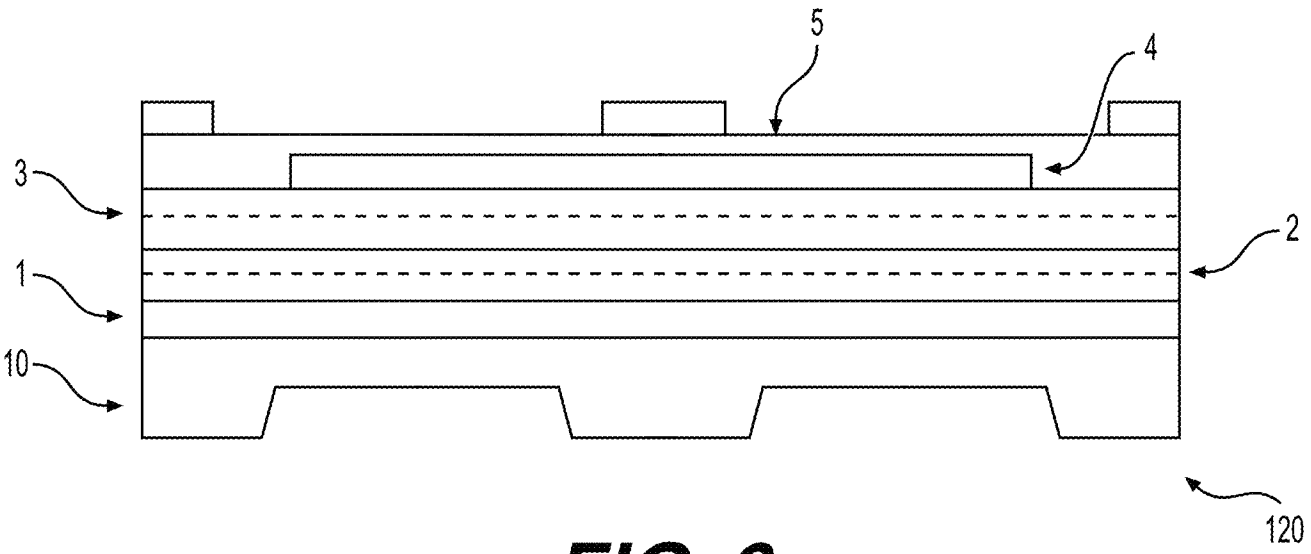
FIG. 6 illustrates a side-vie of a collapsible container in a collapsed position according to an embodiment of the invention.

FIG. 6 illustrates a similar illustration of the collapsible container of FIG. 2 in a collapsed position, with additional details, according to an embodiment of the invention. As shown in FIG. 6, when in the collapsed position, the collapsed container (120) includes the base (10) at the bottom of the collapsed container (120), with the first end panel (1) on top of the base (10), the first side panel (2) on top of the first end panel (1), the second side panel (3) on top of the first side panel (2), the second end panel (4) on top of the second side panel (3), and the top cover (5) on top of all of the panels (1)-(4) and the base (10) of the collapsed container (120). As discussed above, each of the panels (1)-(4) are hingedly attached to the base (10) in a staggered manner (see, e.g., FIG. 4), the first end panel (1) is hingedly attached to the base (10) via a set of panel hinges (8A) that attach directly to the base (10) at the bottom edge of the first end panel (1), the first side panel (2) is hingedly attached to the base (10) via a bottom hinge (8C) that is generally positioned about three inches above the base (10), the second side panel (3) is hingedly attached to the base (10) via a bottom hinge (8C) that is generally positioned about five inches above the base (10), and the second end panel (4) is hingedly attached to the base (10) via a bottom hinge (8C) that is generally positioned about six inches above the base. This staggered positioning of the hinge mechanisms on the panels (1)-(4) allows for (i) the first end panel (1) to fold/collapse on top of the base (10), (ii) the first side panel (2) to fold/collapse on top of the folded first end panel (1), (iii) the second side panel (3) to fold collapse on top of the folded first side panel (2) and the folded first end panel (1), and (iv) the second end panel (4) to fold/collapse on top of the folded second side panel (3), the folded first side panel (2), and the folded first end panel (1).

According to the embodiment of FIG. 6, the top cover (5) nests into the collapsed panels (1)-(4). However, the top cover (5) could alternatively be provided as a separate unit. The top cover (5) can also sit on top of the second end panel (4) in the collapsed position.

According to one embodiment, the collapsible container (100) in the assembled position, as shown in FIG. 4, has external/outside dimensions of 90 inches in length, 57 inches in width, and 90 inches in height. According to the embodiment of FIG. 4, the collapsible container (100) in the assembled position has internal dimensions of 88 inches in length, 56 inches in width, and 84 inches in height. According to another embodiment, the collapsible container (100) in the assembled position, as shown in FIG. 4, has external/outside dimensions of 90 inches in length, 48 inches in width, and 84 inches in height. These dimensions of the collapsible container (100) of FIG. 4 provide 240 cubic feet of interior space in which to store and transport various items for a domestic move and/or an international move. This amount of cubic feet, namely, 240 cubic feet, is relevant as this is the maximum amount of cubic feet that can be provided within these dimensions of the collapsible container (100), which are the dimensions necessary to meet the international/overseas requirements for shipping/transportation. Moreover, the collapsible container (100) in accordance with the principles of the invention may be larger than some conventional liftvans, which typically have: (i) external dimensions of 87 inches×45 inches×87 inches, (ii) internal dimensions of approximately 85 inches×43 inches×80 inches, and (iii) 170 cubic feet (CFT) of capacity. Thus, the larger collapsible container in accordance with the principles of the invention is more suitable for the types of household goods that are generally moved. For example, by having a width of from 48 inches to 57 inches, the collapsible container (100) according to embodiments of the invention is able to maximize the space utilization in a 40' or 53' container (i.e., the dimensions of the shipping containers used in an international/overseas move) in which the collapsible container (100) will be stored. In addition, according to one aspect of the invention, one or more of the panels (1)-(4) of the collapsible container (100) may be corrugated, Which will result in the corrugated panel(s) being about ½ inch thick. As such, the collapsible container (100) according to embodiments of the invention may have the same, if not greater, interior cubic feet (CFT) as the conventionally used liftvans, while maximizing the number of collapsible containers (100) in a 40' or 53' shipping container. Although, the collapsible container (100) according to embodiments of the invention has external/outside dimensions of 90 inches in length, 48 inches to 57 inches in width, and 84 inches to 90 inches in height (in the assembled position), other variations on the dimensions of the collapsible container are possible.

As shown in FIG. 6, once the collapsible container (100) is collapsed into the collapsed position, this collapsed container (120) has dimensions of 90 inches in length, inches to 57 inches in width, and 8 inches to 14 inches in height. These dimensions of the collapsed container (120) of FIG. 6 allow for at least six collapsed containers (120) to be stacked on top of each other and transported within the same space that a single conventional liftvan (e.g., liftvan 150 of FIG. 3) would occupy.

Figure 7:
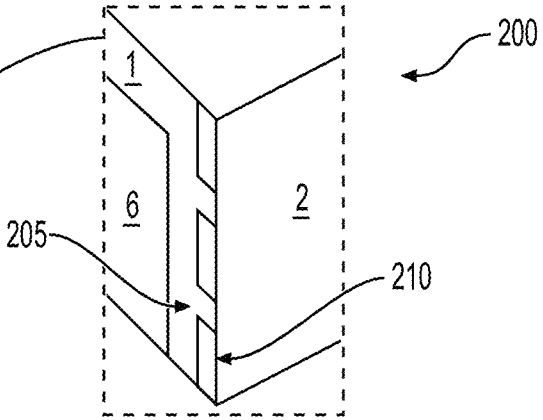
FIG. 7 illustrates a partial, exploded, top perspective view of a notched assembly for two panels of a collapsible container in an assembled position according to an embodiment of the invention.
Figure 8:
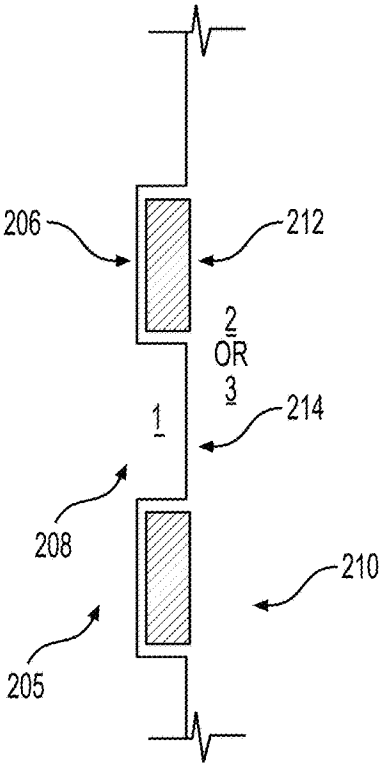
FIG. 8 is a partial, exploded, side-view of a notched design for two panels of a collapsible container in an assembled position according to an embodiment of the invention.

FIG. 7 illustrates a notched assembly for two panels of the collapsible container (100) in the assembled position of FIG. 4, according to an embodiment of the invention. As shown in FIG. 7, in the assembled position, the first end panel (1), which includes the door (6), attaches to the first side panel (2) using a notched design (200). The notched design (200) comprises a notched side edge (205) of the first end panel (1), which mates with a notched side edge (210) of the first side panel (2). The notched side edge (205) of the first end panel (1) mates with the notched side edge (210) of the first side panel (2) similar to the mating of pieces in a jigsaw puzzle. For example, as shown in FIG. 8, the notched side edge (205) of the first end panel (1) includes a plurality of recessed elements (206) that alternate with a plurality of outwardly extending elements (208). Similarly, the notched side edge (210) of the first side panel (2) (or the second side panel (3)) includes a plurality of recessed elements (214) that alternate with a plurality of outwardly extending elements (212), such that (i) the recessed elements (206) of the notched side edge (205) of the first end panel (1) mate with the outwardly extending elements (212) of the notched side edge (210) of the first side panel (2) (or the second side panel (3)), and (ii) the outwardly extending elements (208) of the notched side edge (205) of the first end panel (1) mate with the recessed elements (214) of the notched side edge (210) of the first side panel (2) (or the second side paid (3)). This notched design (200), in combination with, for example, the internal latching mechanism(s) discussed below, provides support to each of the panels (1, 2) by allowing for the panels to easily connect to each other, such that the connected panels aid in keeping each of the panels upright. The notched design (200) also allows for an efficient way to attach the panels together during assembly, without the need for bolts or any spare parts, nails or screws. This aspect of the notched design (200) for the collapsible container (100) is beneficial because it allows for the collapsible container (100) to be self-contained, which means that no spare parts or other attaching means that are external to the container (100) are required for assembling the collapsible container (100). Accordingly, only the notched design (200) and the internal latching mechanism discussed below are required for assembling the collapsible container (100). The notched design (200), as well as the internal latching mechanism discussed below, further prevents the panels from being removed because the panels are locked into each other along the inside of the collapsible container (100), which prevents someone from removing the panels along the outside of the collapsible container (100).

Figure 9A:
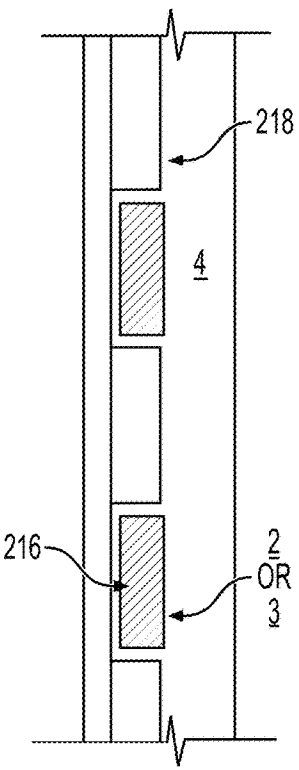
FIG. 9A is a partial, exploded, front view of a notched assembly for two panels of a collapsible container in an assembled position according to an embodiment of the invention.
Figure 9B:
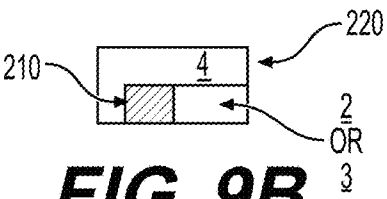
FIG. 9B is a top view of the notched assembly of FIG. 9A according to an embodiment of the invention.

In a similar manner, in the assembled position, the first end panel (1) further attaches to the second side panel (3) using a notched design (e.g., notched design (200) of FIG. 7) along a second side edge (not shown) of the first end panel (1). Accordingly, the second side panel (3) further includes a matching notched design in the same manner of the first side panel (2) (see, e.g., FIGS. 8 and 9A). In addition, in the assembled position, the second end panel (4) attaches to both the first side panel (2) and the second side panel (3) using a notched design notched design (200) of FIG. 7). For example, as shown in FIG. 9A, the second end panel (4) includes a notched side edge (218) that mates with a notched side edge (216) of the first side panel (2) and/or the second side panel (3). These notched side edges (216, 218) include similar recessed elements and outwardly extending elements that mate with their respective counterparts in the manner shown in FIG. 8. FIG. 9B further illustrates a top view of the notched design according to an embodiment of the invention. As shown in FIG. 9B, the second end panel (4) includes a solid member (220) (e.g., a one-inch plastic rib) with the notched design, such that as the notched side edge (218) of the second end panel (4) mates with the notched side edge (216) of the first side panel (2) and/or the second side panel (3), the solid member (220) provides a stopping means to prevent the notched side edges (216, 218) from going past the point of the solid member (220). This solid member (220) (e.g., a one-inch plastic rib) of the notched design of the second end panel (4) runs through the length of the second end panel (4) to provide vertical structural stability to the collapsible container (100) when in the assembled position (see, e.g., FIG. 4). According to an embodiment, lock pins (see, e.g., lock pins 605 of FIGS. 18A and 18B) further connect the solid member (220) (e.g., a one-inch plastic rib) of the second end panel (4) with the first side panel (2) and the second side panel (3).

According to an embodiment, each of the top cover, the first end panel, and the second end panel includes an internal latching mechanism to further attach the various panels to each other and to the top cover. The latching mechanism is "internal" because the components necessary to latch the various panels to each other and to the top cover are contained within the inside of the collapsible container (100). Thus, none of the components of the internal latching mechanism is on the outside of the collapsible container (100) and/or disconnected from the collapsible container (100).

Figure 10:
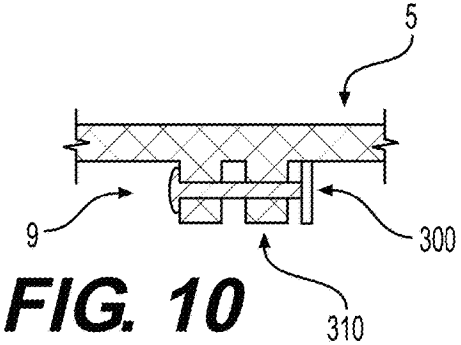
FIG. 10 illustrates a latching mechanism for a collapsible container according to ail embodiment of the invention.

FIG. 10 illustrates an internal latching mechanism (9) for the top cover (5) according to an embodiment of the invention. As shown in FIG. 10, the internal latching mechanism (9) comprises a locking pin (300) that inserts into secure points (310) that extend from the top cover (5). As shown in, for example, FIGS. 1, 5, and 17A, the top cover (5) includes a plurality of secure points (310) and associated locking pins (300) to securely attach the top cover (5) to the top edges of each of the panels (1)-(4). In particular, the secure points (310) of the top cover (5) mate with top edges of the first end panel (1), the first side panel (2), the second side panel (3), and the second end panel (4). Once the top cover (5) is placed on top of the top edges of each of the panels (1)-(4), the locking pin (300) is inserted into the mated secure points (310) to thus attach the top cover (5) to the top edges of each of the panels (1)-(4) in the assembled position. As further shown in FIG. 10, the locking pin (300) is inserted horizontally into the respective secure points (310). According to one embodiment, at least three latching mechanisms (9) that each comprise a locking pin (300) and associated secure points (310) are positioned internally along each side edge of the top cover (5) that, mate with the top edge of the first side panel (2) and the top edge of the second side panel (3), respectively (see, e.g., FIG. 17A), In addition, according to one embodiment, at least two latching mechanisms (9) that each comprise a locking pin (300) and associated secure points (310) are positioned internally along each end of the top cover (5) that urate with the top edge of the first end panel (1) and the top edge of the second end panel (4), respectively (see, e.g., FIG. 17A). According to an embodiment, each of the locking pins (300) is stored within the top cover (5) allowing for the parts needed for assembling the collapsible container (100) with the top cover (5) to be self-contained. Additionally, according to an embodiment, each of the locking pins (300) is attached to the associated secure points (310) via a string or other elongated member (not shown).

Figure 18B:
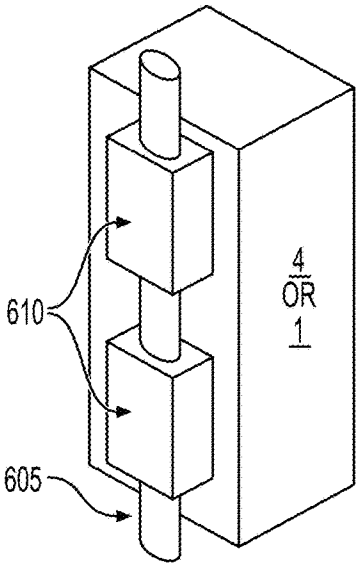
FIG. 18B illustrates a partial, exploded, top perspective view of the latching mechanism of FIG. 18A according to an embodiment of the invention.
Figure 18A:
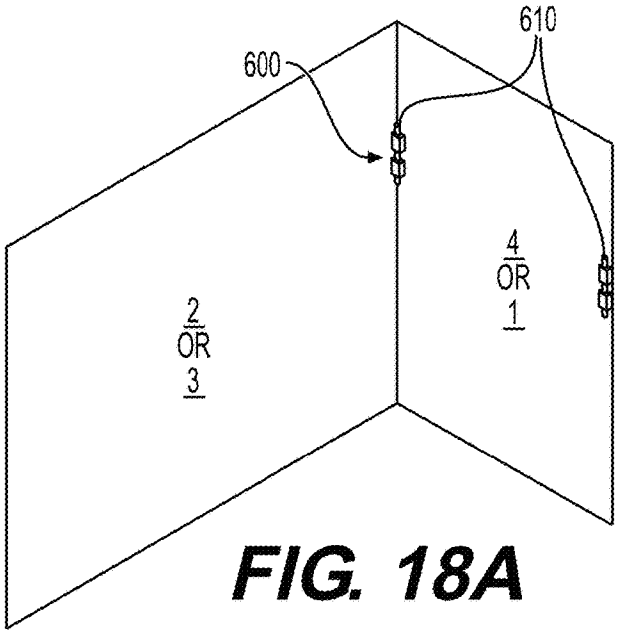
FIG. 18A illustrates a partial, top perspective view of a latching mechanism for two panels of a collapsible container in an assembled position according to an embodiment of the invention.

FIGS. 18A and 18B illustrate an internal latching mechanism (600) for the first end panel (1) and the second end panel (4) according to an embodiment of the invention. As shown in FIGS. 18A and 18B, the internal latching mechanism (600) comprises a lock p (605) that inserts into a plastic bar or extension (610) that includes openings through which the lock pin (605) inserts. This plastic bar or extension (610) is disposed along an interior surface of the first end panel (1) and/or the second end panel (4). According to an embodiment, the plastic bar or extension (610) will be a thicker bar of material (e.g., plastic) that runs the length of the first end panel (1) and/or the second end panel (4). For example, according to one embodiment, with corrugation, one more of the panels (1)-(4) will be a ½ inch panel of plastic, while the plastic bar or extension (610) will comprise a thicker, 1 inch×1 inch, bar of plastic. As shown in FIG. 18A, at least one plastic bar or extension (610) of the internal latching mechanism (600) is disposed along each side edge of the first end panel (1) and/or the second end panel (4). The plastic bars or extensions (610) of the first end panel (1) and/or the second end panel (4) mate with respective side edges of the first side panel (2) and/or the second side panel (3). Once the first end p e (1) and/or the second end panel (4) is attached to the first side panel (2) and/or the second side panel (3), the corresponding locking pin (605) is inserted into the mated plastic bars or extensions (610) to thus attach the first end panel (1) and/or the second end panel (4) with the respective side edges of the first side panel (2) and/or the second side panel (3), in the assembled position. As further shown in FIG. 18B, the locking pin (605) is inserted vertically into the respective plastic bar or extension (610). According to an embodiment, each of the locking pins (605) is stored within the associated end panel (1, 4), allowing for the parts needed for assembling the collapsible container (100) to be self-contained. Additionally, according to an embodiment, each of the locking pins (605) is attached to the associated plastic bars or extensions (610) via a string or other elongated member (not shown). This inclusion of the internal latching (600) along the edges of the first end panel (1) and the second end panel (4) provide added strength and support to the joints of the collapsible container, when in the assembled position (see, e.g., FIG. 4). Moreover, as discussed above, these internal latching mechanisms (9, 600), along with the notched design (200) (discussed above), provide an efficient attach the panels together during assembly, without the need for bolts or any spare parts, nails or screws. This allows for the collapsible container (100) to be self-contained, which means that no spare parts or other attaching means that are external to the container (100) are required for assembling the collapsible container (100). Accordingly, only the notched design (200) (discussed above) and the internal latching mechanisms (9, 600) are required for assembling collapsible container (100).

Figure 11:
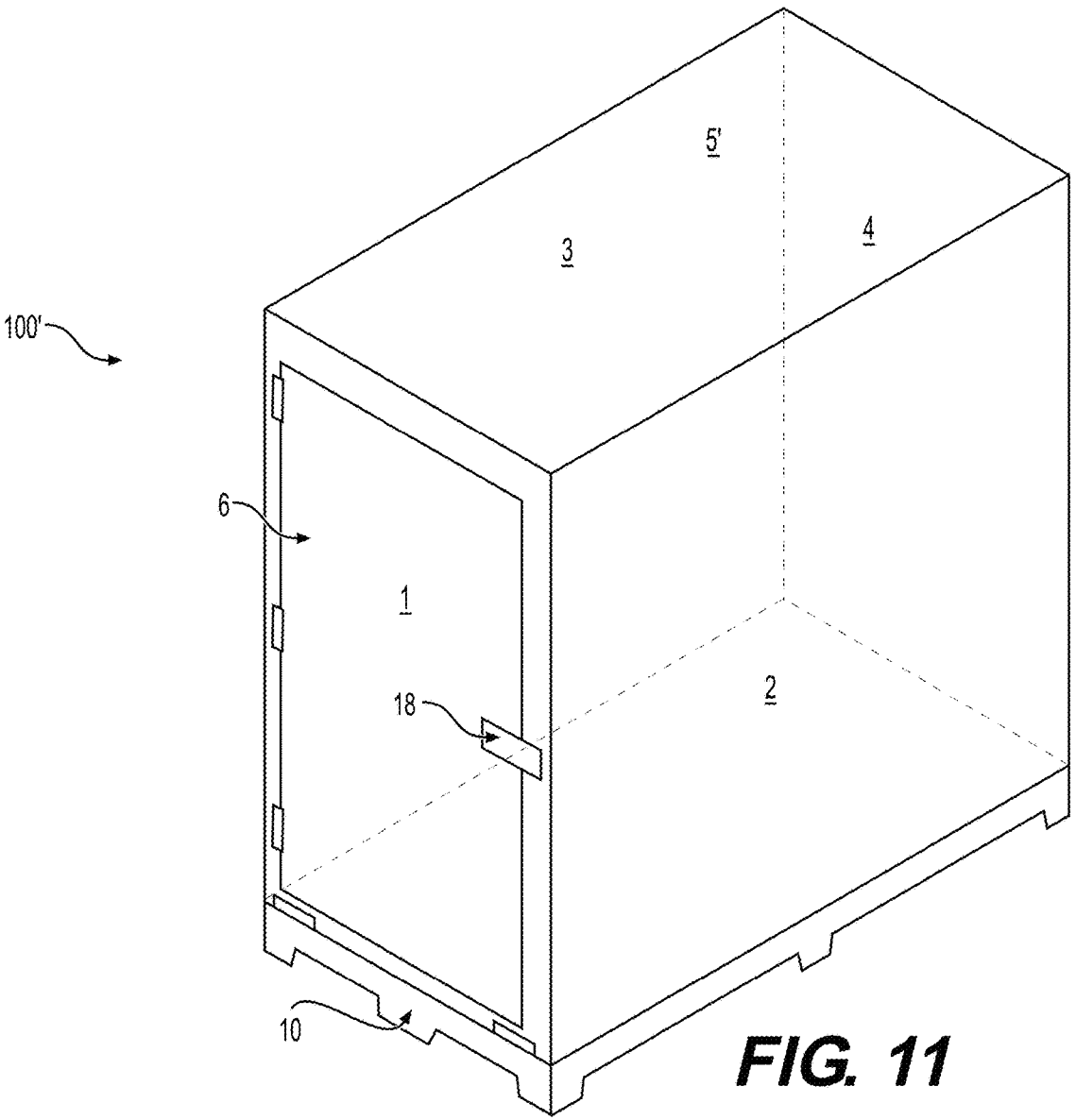
FIG. 11 illustrates a collapsible container in an assembled position according to an embodiment of the invention.

FIG. 11 illustrates a collapsible container (100') according to another embodiment of the invention. As shown in FIG. 11, the collapsible container (100') includes a base (10), a first end panel (1), a first side panel (2), a second side panel (3), a second end panel (4), and a top cover (5'). The first end panel (1) is hingedly attached to the base (10) via a hinge mechanism (not shown). The second end panel (4) is also hingedly attached to the base (10) via a hinge mechanism (not shown). The first side panel (2) is hingedly attached to the base (10) via a hinge mechanism (not shown). Similar to the first side panel (2), the second side panel (3) is hingedly attached to the base (10) via a hinge mechanism (not shown). As also shown in FIG. 11, the first end panel (1) includes a door (6). The door (6) is hingedly attached to the first end panel (1) via a set of hinges (not shown). The door (6) is further configured to be locked or sealed via a locking means (18) disposed along one side of the door (6). This locking means (18) allows for items contained within the container (100') to be securely stored during shipping and/or transport of the container (100'). According to the embodiment of FIG. 11, the collapsible container (100') has dimensions of 90 inches in length, 48 inches to 57 inches in width, and 84 inches to 90 inches in height, which provides for 240 cubic feet of storage space within the collapsible container (100') when in the assembled position.

Figure 12A:
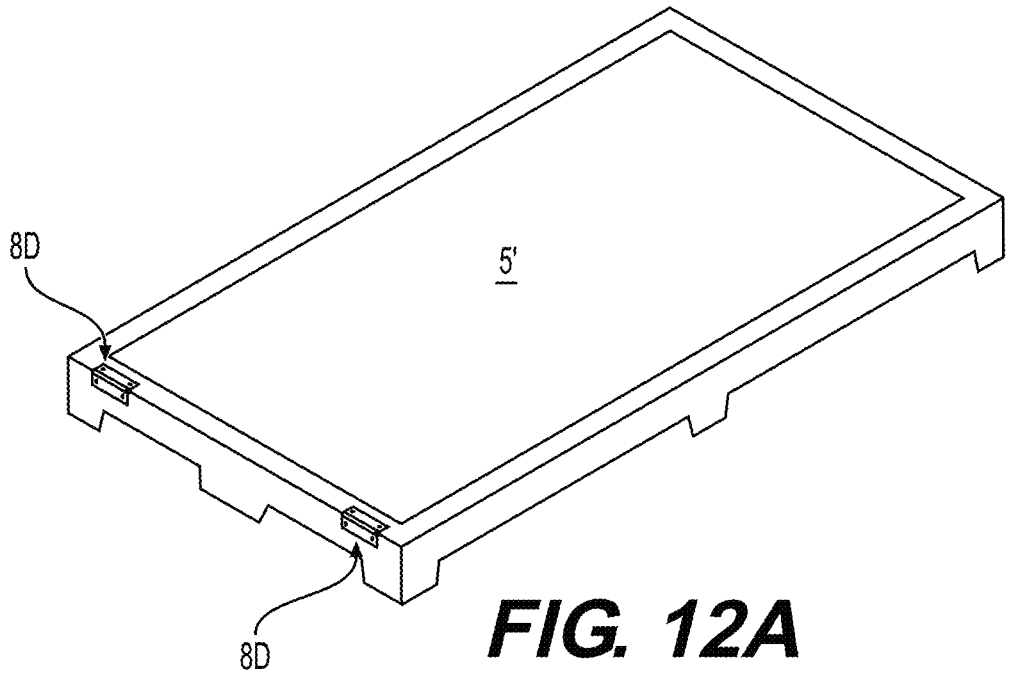
FIG. 12A illustrates a top cover or id for a collapsible container according to an embodiment of the invention.
Figure 12B:
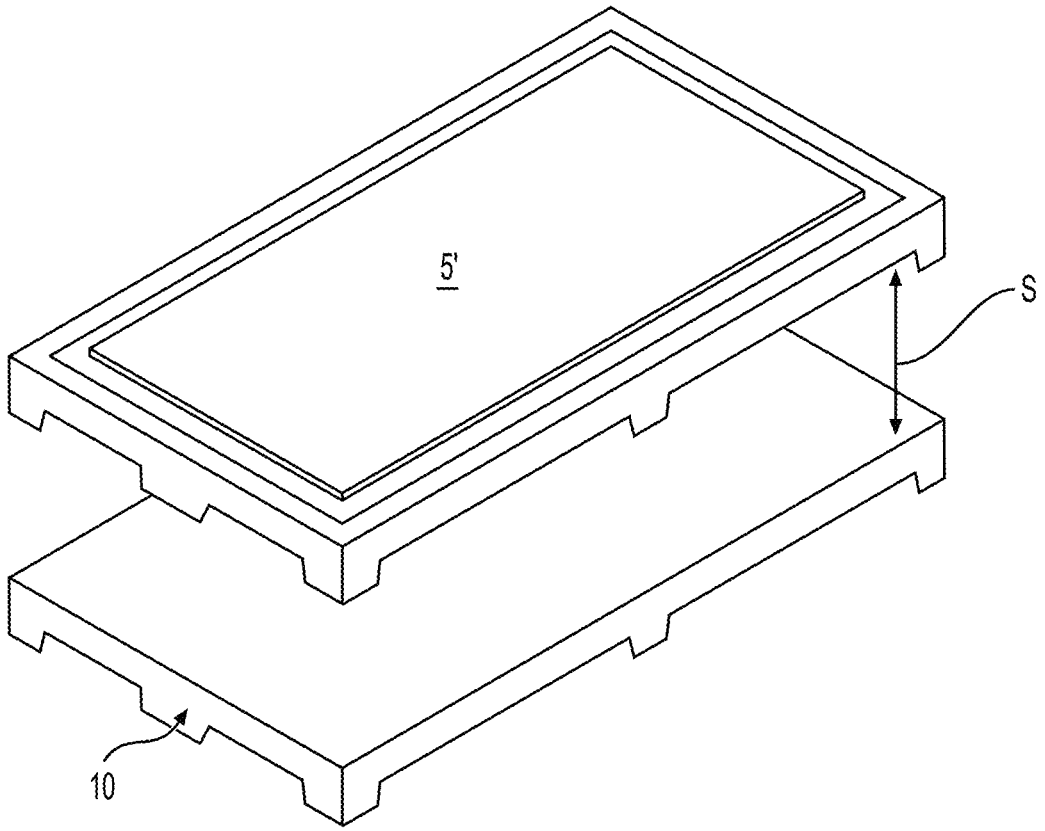
FIG. 12B illustrates a positioning of a top cover or lid with respect to a base of collapsible container according to an embodiment of the invention.

FIG. 12A illustrates the top cover (5') of the container (100') of FIG. 11 according to an embodiment of the invention. According to the embodiment of FIG. 12A, the top cover (5') is configured to be hingedly attached to the top edge of at least the first end panel (1) via a set of hinges (8D). FIG. 12B illustrates the top cover (5') of FIG. 12A in combination with the base (10) of the collapsible container in a proposed collapsed position according to an embodiment of the invention. In the collapsed position, a space S, as shown in FIG. 12B, is provided between the top cover (5') and the base (10) in which the panels can be positioned in the following order: base (10); first end panel (1); first side panel (2); second side panel (3); second end panel (4); and top cover (5'). According to the embodiment of FIG. 12B, the top cover (5') is configured to nest into the collapsed panels.

Figure 13:
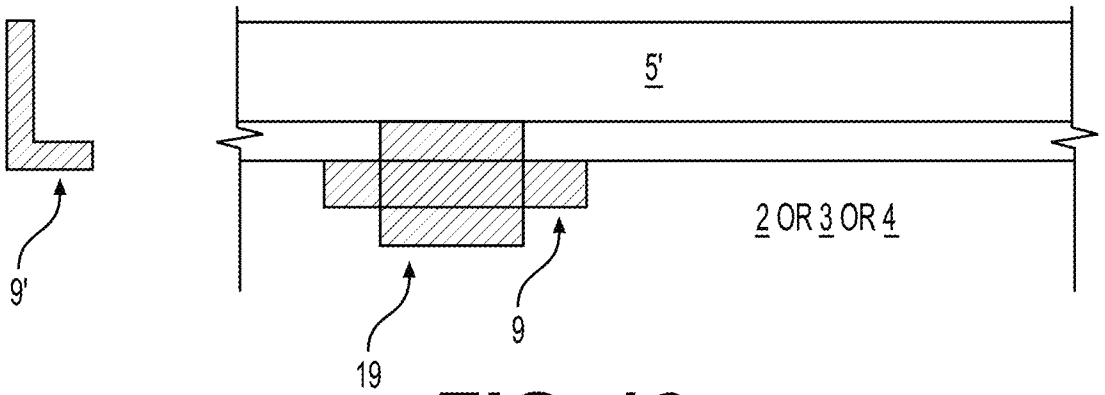
FIG. 13 illustrates a top cover or lid with a latching mechanism for a collapsible container according to an embodiment of the invention.

FIG. 13 illustrates a latching mechanism of the top cover (5') according to an embodiment of the invention. As shown in FIG. 13, the top cover (5') includes an internal latching mechanism (9) that comprises a metal or plastic latch that secures the top cover (5') to each of the top edges of at least the first and second side panels (2, 3) and/or the second end panel (4) by extending through an extension member (19) attached to either the top cover (5') or the first and second side panels (2, 3) and/or the second end panel (4). The top cover (5') can further include a plastic or metal swinging hinge lock (9') for securing the top cover (5') to at least the top edge of the first end panel (1). According to an embodiment, the lid height of the top cover (5') can be increased to allow for lore cubic feet within the collapsible container (100') when in the assembled position.

Figure 14:
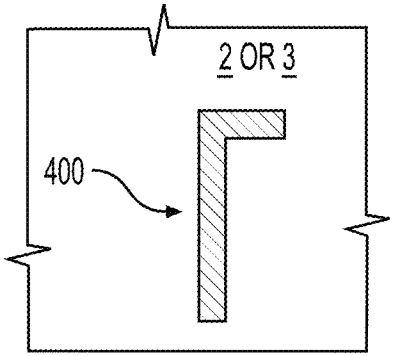
FIG. 14 illustrates an internal pin mechanism for a collapsible container according to an embodiment of the invention.

FIG. 14 illustrates an internal pin (400) that can be included with one or more of the panels (1, 2, 3, 4) of the collapsible container (100') according to an embodiment of the invention. As shown in FIG. 14, the internal pin (400) can be included within one or more of the panels (1, 2, 3, 4) of the collapsible container (100') in order to hold the respective panel(s) upright during assembly. However, the collapsing sequence anchor assembly sequence can be created in a manner that avoids the need for such an internal pin (400).

Figure 15:
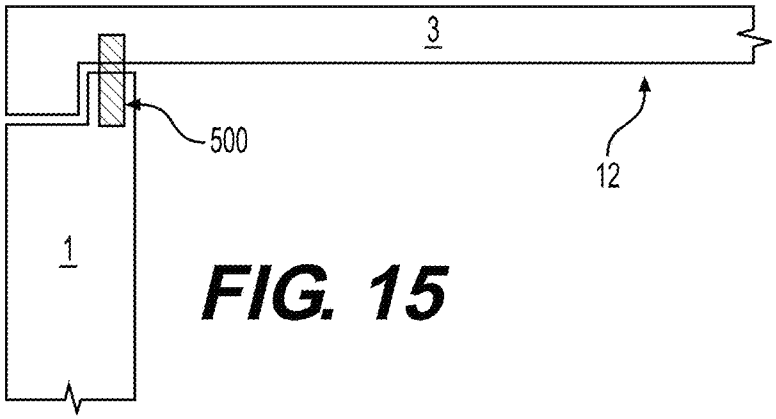
FIG. 15 illustrates a partial, top view of a latching mechanism for connecting panels of a collapsible container according to an embodiment of the invention.

FIG. 15 illustrates an internal latching mechanism for attaching the panels of the collapsible container (100') according to an embodiment of the invention. As shown in FIG. 15, the internal latching mechanism (500) comprises a plastic or metal latch that attaches, for example, the first end panel (1) to the second side panel (3). The internal latching mechanism (500) can be also be used to attach (i) the first end panel (1) to the first side panel (2), (ii) the second end panel (4) to the first side panel (2), and (iii) the second end panel (4) to the second side panel (3). As also shown in the embodiment of FIG. 15, at least the second side panel (3) comprises a corrugated plastic side (12) (see also, e.g., FIG. 29).

Figure 16:
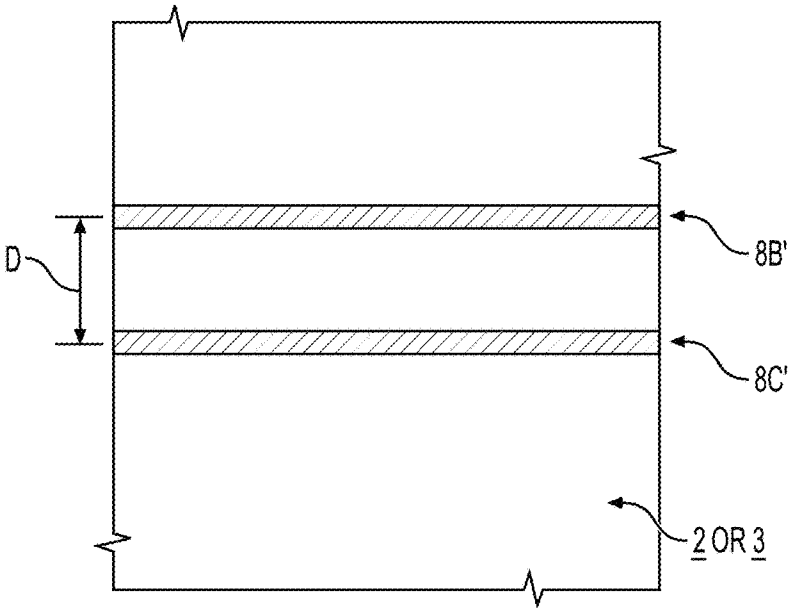
FIG. 16 illustrates a partial, exploded, side-view of a hinge positioning of a pan& for a collapsible container according to an embodiment of the invention.

FIG. 16 illustrates a proposed positioning of panel hinges according to an embodiment of the invention. As shown in FIG. 16, both the first side panel (2) and the second side panel (3) can include an upper hinge (8B') and a lower hinge (8C') that are disposed about two inches apart (see, e.g., distance D of FIG. 16), such that the upper hinge (8B') allows for the first side panel (2) and the second side panel (3) to be bi-folding panels. Accordingly, the upper hinge (8B') is generally disposed along a mid-point of the first side panel (2) and the second side panel (3) to allow for each of these panels to fold in-half.

Another embodiment includes a method of assembling a collapsible container that includes (a) providing a collapsible container that includes (i) a base, (a) a first, side panel hingedly attached to the base, (iii) a second side panel hingedly attached to the base, (iv) a first end panel hingedly attached to the base, and (v) a second end panel hingedly attached to the base, (b) lifting the second end panel to an upright position, (c) lifting the second side panel to an upright position, (d) attaching the second side panel to the second end panel, (e) lifting the first side panel to an upright position, (f) attaching the first side panel to the second end panel, (g) lifting the first end panel to an upright position, and (h) attaching the first end panel to both the first side panel and the second side.

Figure 17A:
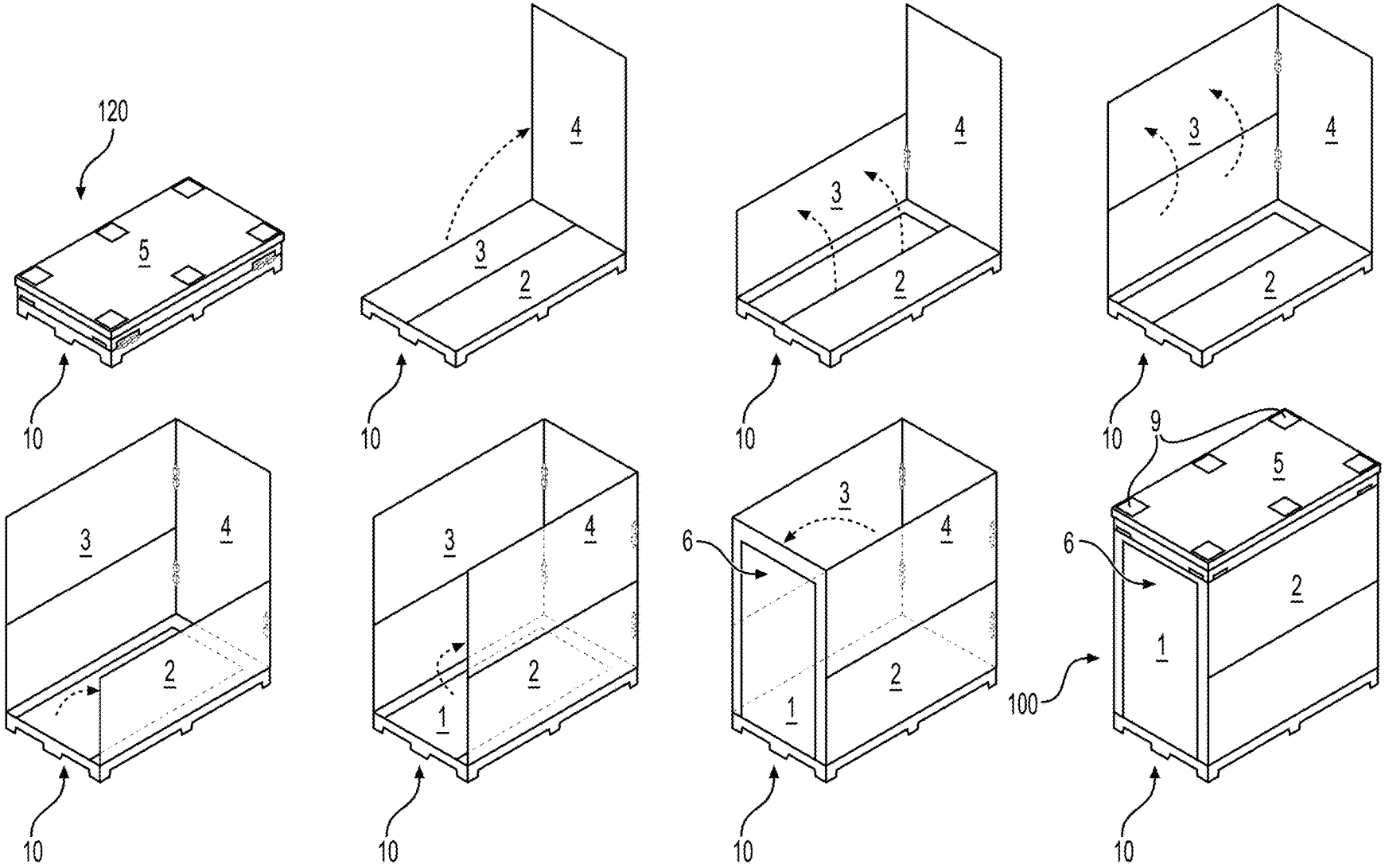
FIG. 17A illustrates a method of assembling a collapsible container from a collapsed position to an assembled position according to an embodiment of the invention.

FIG. 17A illustrates a method of assembling a collapsible container from a collapsed position to an assembled position according to an embodiment of the invention. As shown in FIG. 17A, to start the method of assembling the collapsible container, a collapsed container (120) is provided (Step 0) in which the base (10) is disposed at the bottom of the collapsed container (120), the top cover (5) is disposed at the top of the collapsed container (120), and each of the panels (1, 2, 3, 4) are disposed between the base (10) and the top cover (5) of the collapsed container (120). In the collapsed position, the top cover (5) of the collapsed container (120) can be secured to the base (10) using an internal latching mechanism that includes a plurality of locking pins (see, e.g., internal latching mechanism (9) with locking pins (300) of FIG. 10). Thereafter, the top cover (5) is removed from the collapsed container (120). Next, in the first step of assembly (Step 1), the second end panel (4) is lifted into an upright or standing position using the hinged mechanism at which the second end panel (4) is attached to the base (10) (see, e.g., hinge (8C) of the second end panel (4) of FIG. 4). Next (Step 2), the second side panel (3), in the hi-folded position, is lifted into an upright position using the hinged mechanism at which the second side panel (3) is attached to the base (10) (see, e.g., hinge (8C) of the second side panel (3) of FIG. 4). At this Step 2, the second side panel (3), in the hi-folded position, can be attached to the second end panel (4) using the previously-described notched design and an internal latching mechanism that includes a lock pin that is inserted into a plastic bar disposed along a side edge of the second end panel (4) (see, e.g., internal latching mechanism (600) with lock pin (605) and plastic bar (610) of FIGS. 18A and 18B). In Step 3, the second side panel (3) is then lifted into a fully upright or standing position, from the hi-folded position, using the hinged mechanism disposed along the midpoint of the second side panel (3) (see, e.g., hinge (8B) of the second side panel (3) of FIG. 4). In Step 3, in the fully upright or standing position, the second side panel (3) is attached to the standing second end panel (4) using the above-described notched design and the above-discussed internal latching mechanism that comprises a lock pin that inserts into a plastic bar disposed along the side edge of the second end panel (4) (see, e.g., FIGS. 18A and 18B). In the next Step 4, the first side panel (2), in the bi-folded position, is lifted into an upright position using the hinged mechanism at which the first side panel (2) is attached to the base (10) (see, e.g., hinge (8C) of the first side panel (2) of FIG. 4). At this Step 4, the first side panel (2), in the hi-folded position, can be attached to the second end panel (4) using the previously-described notched design and above-discussed internal latching mechanism that comprises a lock pin that inserts into a plastic bar disposed along a side edge of the second end panel (4) (see, e.g., FIGS. 18A and 18B). In Step 5, the first side panel (2) is then lifted into a fully upright or standing position, from the hi-folded position, using the hinged mechanism disposed along the midpoint of the first side panel (2) (see, e.g., hinge (8B) of the first side panel (2) of FIG. 4). In Step 5, in the fully upright or standing position, the first side panel (2) is attached to the standing second end panel (4) using the above-described notched design and the above-discussed internal latching mechanism that comprises a lock pin that inserts into a plastic bar disposed along the side edge of the second end panel (4) (see, e.g., FIGS. 18A and 18B). Next, in Step 6, the first end panel (1) is lifted into an upright or standing position using the hinged mechanism at which the first end panel (1) is attached to the base (10) (see, e.g., panel hinges (8A) of the first end panel (1) of FIG. 4). Given that the first end panel (1) has a door (see, e.g., door (6) of FIG. 4), the first end panel (1) can be lifted into the standing or upright position and attached to the first side panel (2) and the second side panel (3) from the inside of the collapsible container. As previously discussed, the first end panel (1) is attached to the standing first side panel (2) and the standing second side panel (3) using the above-described notched design and the above-discussed internal latching mechanism(s) that comprises a lock pin that inserts into a plastic bar disposed along the side edge(s) of the first end panel (1) (see, e.g., FIGS. 18A and 18B). Finally, in the last step (Step 7), the top cover (5) is positioned on top of the standing panels (1, 2, 3, 4). Alternatively, if the top cover (5) is hingedly attached to, e.g., the first end panel (1) (see, e.g., top cover (5') of FIG. 12A), the top cover (5) would be placed into position on top of the standing panels (1, 2, 3, 4) using a hinge mechanism. The top cover (5) is further attached to each of the top edges of the standing panels (1, 2, 3, 4) using the above-described latching mechanism (see, e.g., FIG. 10). At this last step (Step 7), the collapsible container (100) is now in the assembled position. According to one embodiment, this method of assembling the collapsible container (100) into the assembled position can be conducted by a single person. According to an embodiment, this method of assembling the collapsible container (100) into the assembled position can be conducted within five minutes.

Another embodiment includes a method of collapsing a collapsible container that includes (a) providing a collapsible container that includes (i) a base, (ii) a first side panel hingedly attached to the base and positioned in an upright position, (iii) a second side panel hingedly attached to the base and positioned in an upright position, (iv) a first end panel hingedly attached to the base and positioned in an upright position, and (v) a second end panel hingedly attached to the base and positioned in an upright position, (b) folding the first end panel down, such that the first end panel is positioned on top of the base, (c) folding the first side panel down, such that the first side panel is positioned on top of the first end panel, (d) folding the second side panel down, such that the second side panel is positioned on top of the first side panel, and (e) folding the second end panel down, such that the second end panel is positioned on top of the second side panel. According to one embodiment, the method of collapsing the collapsible container is generally the steps illustrated in FIG. 17A in the reverse order.

Figure 17B:
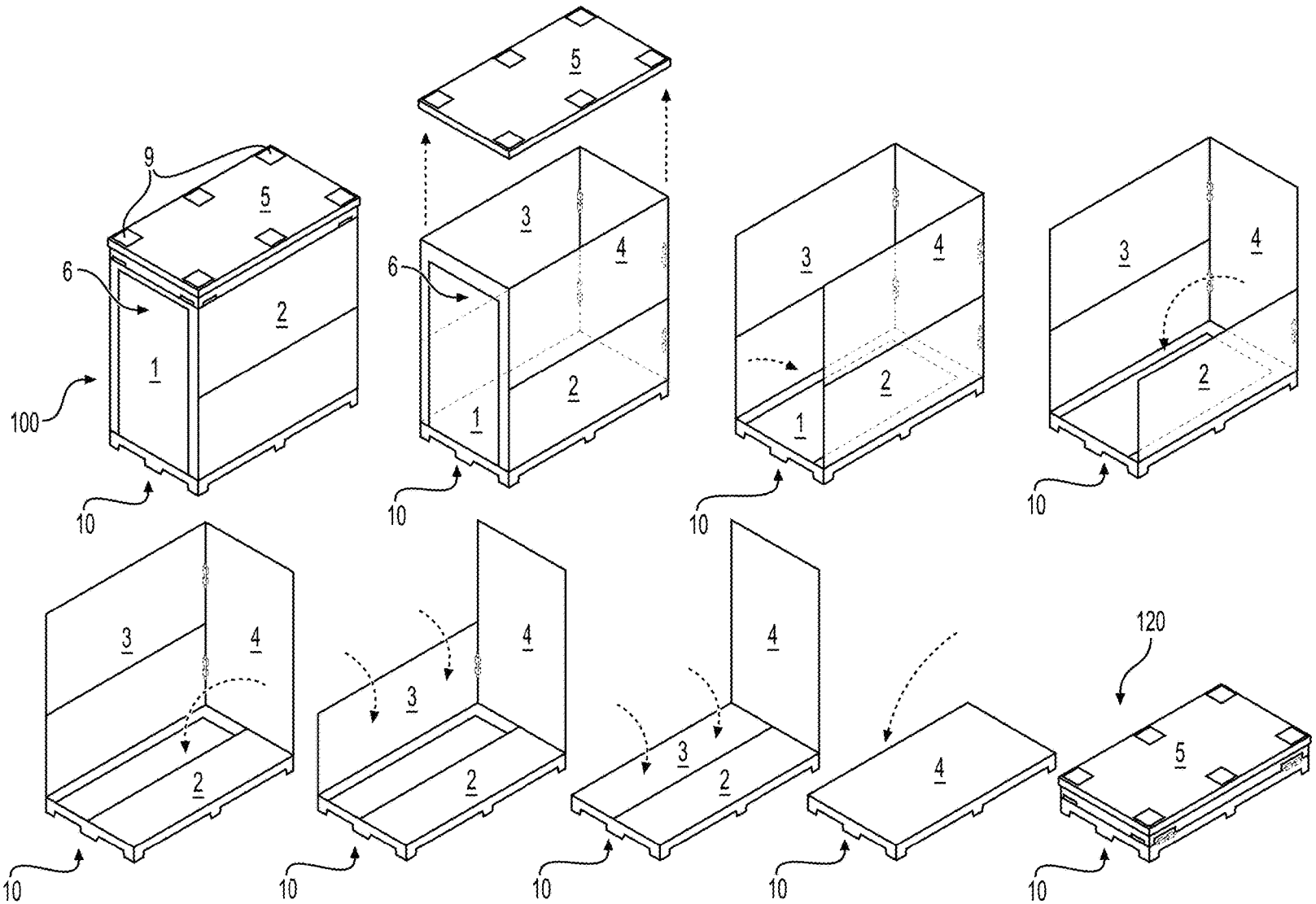
FIG. 17B illustrates a method of collapsing a collapsible container from an assembled position to a collapsed position according to an embodiment of the invention.

FIG. 17B illustrates a method of collapsing a collapsible container from an assembled position to a collapsed position according to an embodiment of the invention. As shown in FIG. 17B, to start the method of collapsing the collapsible container, a collapsible container (100) is provided (Step 0) that includes (i) a base (10), (ii) a first side panel (2) hingedly attached to the base (10) and positioned in an upright position, (iii) a second side panel (3) hingedly attached to the base (10) and positioned in an upright position, (iv) a first end panel (1) hingedly attached to the base (10) and positioned in an upright position, (v) a second end panel (4) hingedly attached to the base (10) and positioned in an upright position, and (vi) a top cover (5). Thereafter, in the next step (Step 1), the top cover (5) is removed from the collapsible container (100). In the next step (Step 2), the first end panel (1) is folded down or inward, such that the first end panel (1) is positioned on top of the base (10). In the next step (Step 3), the first side panel (2) is folded down into the bi-folded position (e.g., 180 degrees inward), using the hinged mechanism disposed along the midpoint of the first side panel (2) (see, e.g., hinge (8B) of the first side panel (2) of FIG. 4). Next (Step 4), the first side panel (2) is folded all the way down (e.g., 90 degrees inward) using the hinged mechanism at which the first side panel (2) is attached to the base (10) (see, e.g., hinge (8C) of the first side panel (2) of FIG. 4), such that the first side panel (2) is positioned on top of the first end panel (1). Thereafter, in the next step (Step 5), the second side panel (3) is folded down into the bi-folded position (e.g., 180 degrees inward), using the hinged mechanism disposed along the midpoint of the second side panel (3) (see, e.g., hinge (8B) of the second side panel (3) of FIG. 4). Next (Step 6), the second side panel (3) is folded all the way down (e.g., 90 degrees inward) using the hinged mechanism at which the second side panel (3) is attached to the base (10) (see, e.g., hinge (8C) of the second side panel (3) of FIG. 4), such that the second side panel (3) is positioned on top of the first end panel (1) and adjacent to the first side panel (2). Next (Step 7), the second end panel (4) is folded down or inward (e.g., 90 degrees), such that the second end panel (4) is positioned on top of the first side panel (2) and the second side panel (3). Thereafter, in the last step (Step 8), the top cover (5) is positioned on top of the second end panel (4) to protect all of the panels (1, 2, 3, 4). At this last step (Step 8), the collapsible container (100) is now in the collapsed position. This collapsed container (120) of the last step (Step 8) includes the base (10) disposed at the bottom of the collapsed container (120), the top cover (5) disposed at the top of the collapsed container (120), and each of the panels (1, 2, 3, 4) disposed between the base (10) and the top cover (5) of the collapsed container (120). In the collapsed position, the top cover (5) of the collapsed container (120) can be secured to the base (10) using an internal latching mechanism that includes a plurality of locking pins (see, e.g., internal latching mechanism (9) with locking pins (300) of FIG. 10). According to one embodiment, this method of collapsing the collapsible container (100) into the collapsed position can be conducted by a single person. According to an embodiment, this method of collapsing the collapsible container (100) into the collapsed position can be conducted within five minutes.

Figure 19:
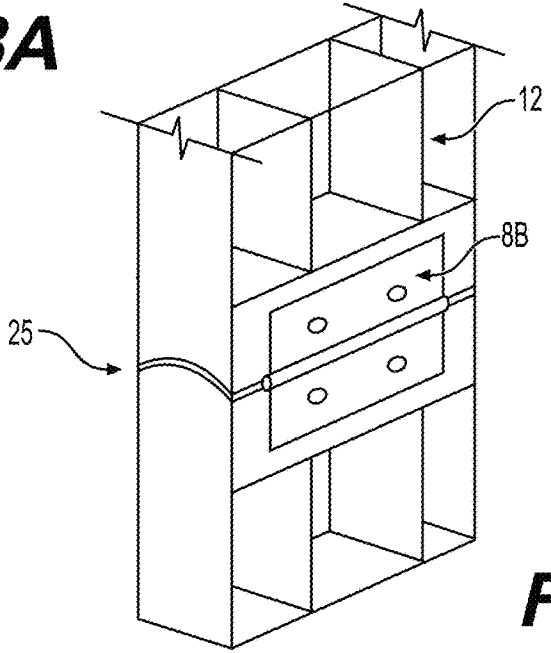
FIG. 19 illustrates a partial, exploded, top perspective view of a hinge mechanism attached to a side panel of a collapsible container according to an embodiment of the invention.

FIG. 19 illustrates a hinge mechanism for the first side panel (2) and the second side panel (3) according to an embodiment of the invention. As shown in FIG. 19, the hinge mechanism comprises a hinge (8B) which is disposed along a mid-point of the first side panel (2) and the second side panel (3), which allows for the first side panel (2) and the second side panel (3) to fold in-half (i.e., the first side panel (2) and the second side panel (3) are both bi-folding panels) (see, e.g., FIGS. 1 and 4). According to the embodiment of FIG. 19, an arch joint (25) is provided along the mid-point of the first side panel (2) and the second side panel (3) at which the hinge (8B) is provided, in order to allow for the first side panel (2) and the second side panel (3) to be water resistant. In addition, according to the embodiment of FIG. 19, the first side panel (2) and/or the second side panel (3) comprises a corrugated plastic material (12) (see also, e.g., FIG. 29).

Figure 20:
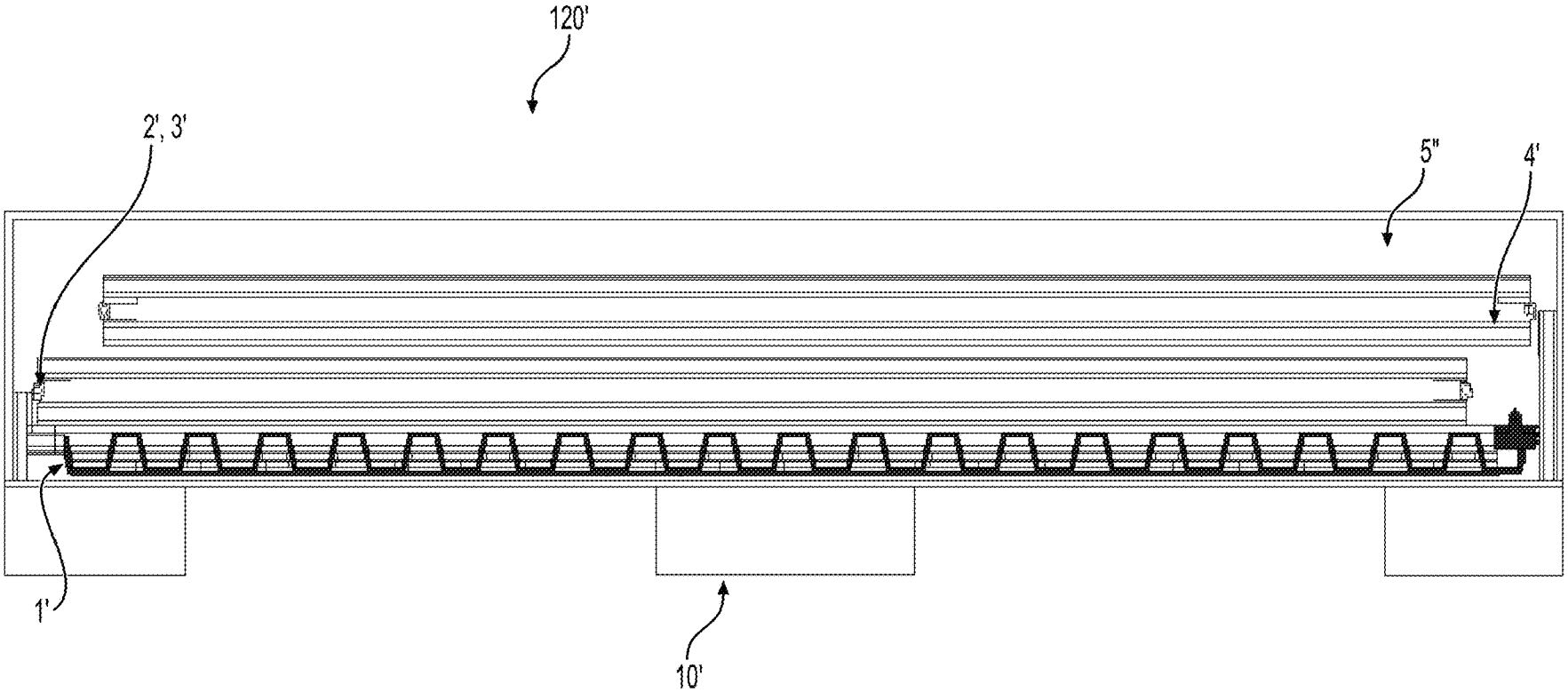
FIG. 20 illustrates a side-vie of a collapsible container in a collapsed position according to an embodiment of the invention.

FIG. 20 illustrates the collapsible container of FIGS. 1 and 2 in a collapsed position, with additional details, according to another embodiment of the invention. As shown in FIG. 20, when in the collapsed position, the collapsed container (120') includes a base (10') at the bottom of the collapsed container (120'), with a first end panel (1') on top of the base (10'), a first side panel (2') and a second side panel (3') on top of the first end panel (1'), a second end panel (4') on top of the first side panel (2') and the second side panel (3'), and a top cover (5") on top of all of the panels (1')-(4') and the base (10') of the collapsed container (120'). As discussed above, each of the panels (1')-(4') can be hingedly attached to the base (10') in a staggered manner (see, e.g., FIG. 4) This staggered positioning of the hinge mechanisms on the panels (1')-(4') allows for (i) the first end panel (1') to fold/collapse on top of the base (10'), (ii) the first side panel (2') to fold/collapse on top of the folded first end panel (1'), (iii) the second side panel (3') to fold/collapse on top of the folded first side panel (2') and/or the folded first end panel (1'), and (iv) the second end panel (4') to fold/collapse on top of the folded second side panel (3'), the folded first side panel (2'), and the folded first end panel (1').

According to the embodiment of FIG. 20, the top cover (5") nests into the collapsed panels (1')-(4'). However, the top cover (5") could alternatively be provided as a separate unit. The top cover (5") can also sit on top of the second end panel (4') in the collapsed position. According to one embodiment, a height of the collapsed container (120') from the bottom of the base (10') to the top of the top cover (5") is about 8.1 inches. According to another embodiment, a height of the collapsed container (120') from the top of the base (10') to the bottom of the top cover (5") is about 4.56 inches.

Figure 21C:
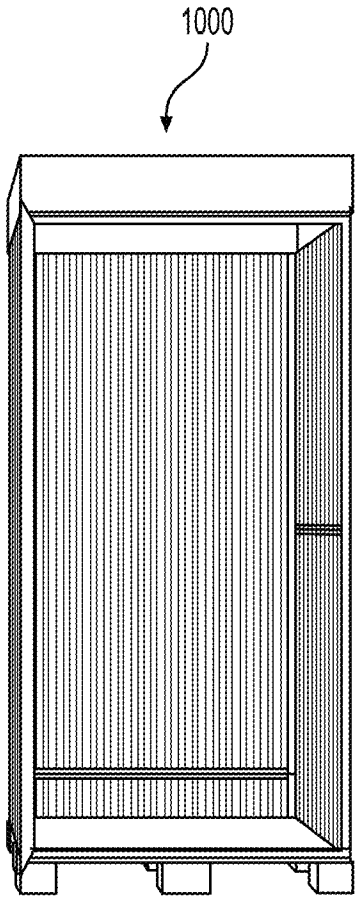
FIG. 21C illustrates a front view of an open collapsible container in an assembled position for receiving the plurality of collapsible containers in a collapsed position of FIG. 21B according to an embodiment of the invention.
Figure 21B:
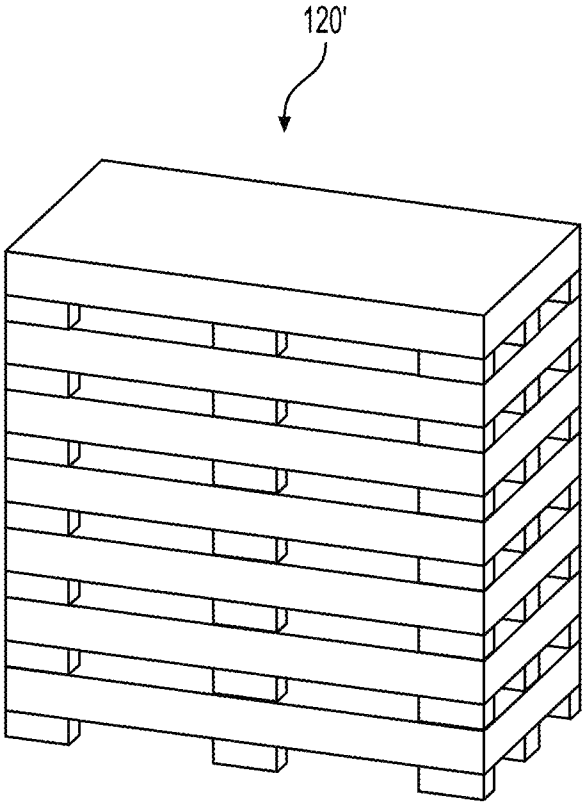
FIG. 21B illustrates a top perspective view of a plurality of collapsible containers in a collapsed position, as shown in FIG. 21A, according to an embodiment of the invention.
Figure 21A:
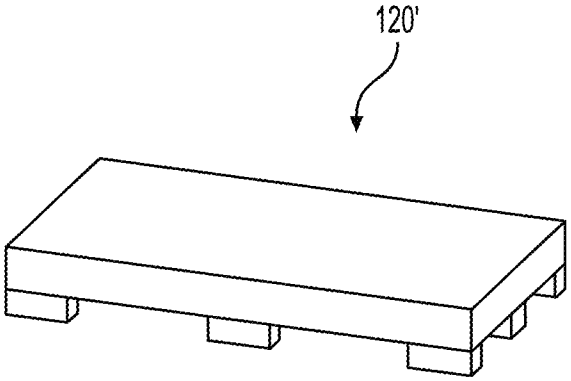
FIG. 21A illustrates a top perspective view of a collapsible container in a collapsed position according to an embodiment of the invention.

FIGS. 21A to 21C illustrate the stacking of collapsed containers according to an embodiment of the invention. As shown in FIG. 21A the collapsed container (120') of FIG. 20 is provided that includes the base (10') disposed at the bottom of the collapsed container (120'), the top cover (5") disposed at the top of the collapsed container (120'), and each of the panels (1', 2', 4') disposed between the base (10') and the top cover (5") of the collapsed container (120'). As shown in FIG. 21B, seven collapsed containers (120') are stacked on topped of each other. This stack of seven collapsed containers (120') are dimensioned such that they fit within the volume of an assembled container (1000), as shown in FIG. 21C. According to one embodiment, the top cover (5") of each of the collapsible containers (120') is configured to support the total weight of the other six collapsed containers (120') stacked on top of it (see, e.g., Example 2 and FIG. 31).

Figure 22:
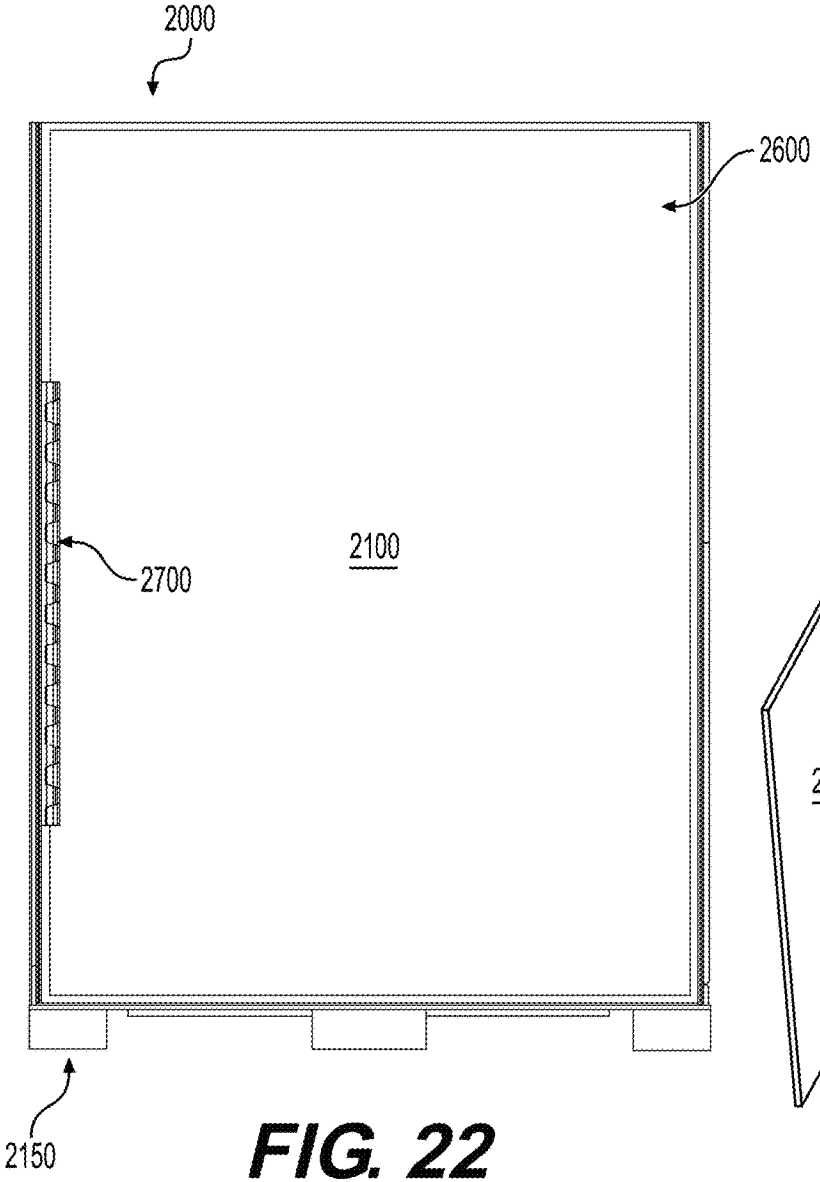
FIG. 22 illustrates a front view of a collapsible container in an assembled position according to an embodiment of the invention.

FIG. 22 illustrates a front vie of a collapsible container in an assembled position according to another embodiment of the invention. As shown in FIG. 22, the collapsible container (2000) includes a base (2150) and a first end panel (2100) having a door (2600) that is attached via a hinged mechanism (2700) along one side edge of the first end panel (2100). As shown in the embodiment of FIG. 22, the door (2600) of the first end panel (2100) is sized such that a standing person can walk into the interior of the collapsible container (2000).

Figure 23:
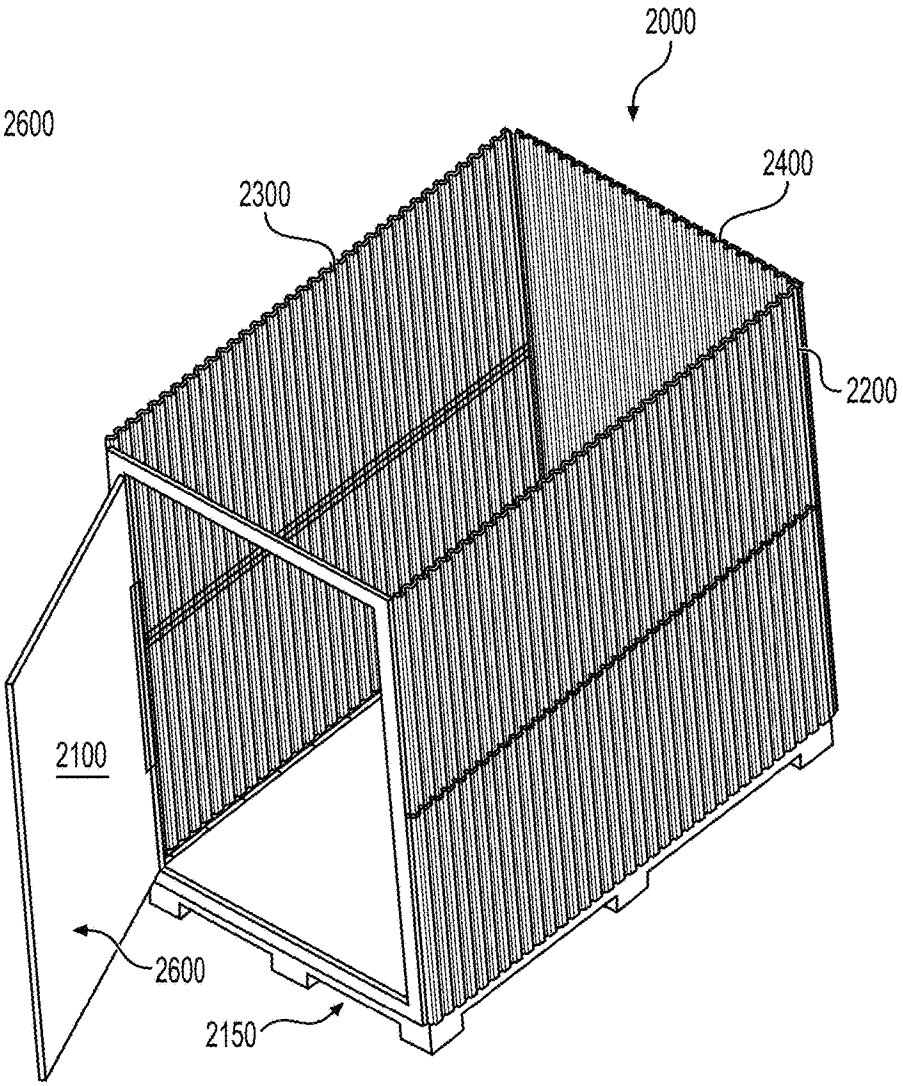
FIG. 23 illustrates a top perspective view of an open collapsible container in an assembled position according to an embodiment of the invention.

FIG. 23 illustrates a top perspective view of the collapsible container (2000) of FIG. 22 according to an embodiment of the invention. As shown in FIG. 23, the collapsible container (2000) includes a base (2150), a first end panel (2100) having a door (2600), a first side panel (2200), a second side panel (2300), and a second end panel (2400). In the embodiment of FIG. 23, the door (2600) of the first end panel (2100) is open to allow for a person to enter the interior of the collapsible container (2000). The collapsible container (2000) of FIG. 23 is shown without a top cover, which allows for the corrugation of the first side panel (2200), the second side panel (2300), and the second end panel (2400) to be observed (see also, e.g., FIG. 29).

Figure 24:
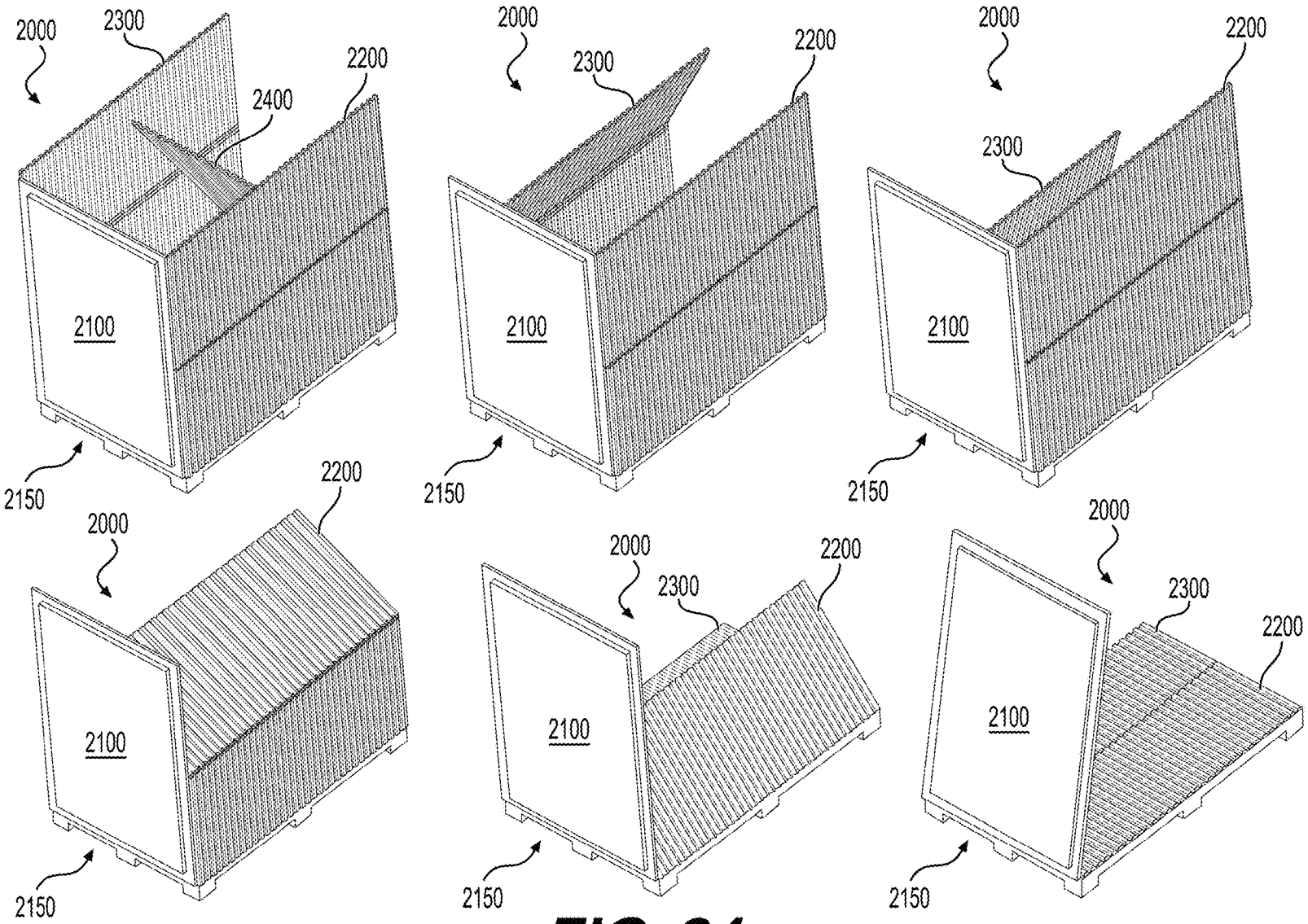
FIG. 24 illustrates a method of collapsing a collapsible container from an assembled position to a collapsed position according to an embodiment of the invention.

FIG. 24 illustrates a method of collapsing a collapsible container from an assembled position to a collapsed position according to another embodiment of the invention. As shown in FIG. 24, to start the method of collapsing the collapsible container, the collapsible container (2000) of FIGS. 22 and 23 is provided (Step 0), which includes (i) a base (2150), (ii) a first side panel (2200) hingedly attached to the base (2150) and positioned in an upright position, (iii) a second side panel (2300) hingedly attached to the base (2150) and positioned in an upright position, (iv) a first end panel (2100) hingedly attached to the base (2150) and positioned in an upright position, and (v) a second end panel (2400) hingedly attached to the base (2150) and being collapsed from an upright position to a folded position onto the base (2150). Thereafter, in the next step (Step 1), the second side panel (2300) is folded down into thein-folded position, using the hinged mechanism disposed along the midpoint of the second side panel (2300) (see, e.g., hinge (8B) of the second side panel (3) of FIG. 4). Next (Step 2), the second side panel (2300) is folded all the way down using the hinged mechanism at which the second side panel (2300) is attached to the base (2150) (see, hinge (8C) of the second side panel (3) of FIG. 4), such that the second side panel (2300) is positioned on top of the second end panel (2400). Thereafter, in the next step (Step 3), the first side panel (2200) is folded down into the hi-folded position, using the hinged mechanism disposed along the midpoint of the first side panel (2200) (see, e.g., hinge (8B) of the first side panel (2) of FIG. 4). Next (Step 4), the first side panel (2200) is folded all the way down g the hinged mechanism at which the first side panel (2200) is attached to the base (2150) (see, e.g., hinge (8C) of the first side panel (2) of FIG. 4), such that the first side panel (2200) is positioned on top of the second end panel (2400) and adjacent to the second side panel (2300). Next (Step 5), the first end panel (2100) is folded down, such that the first end panel (2100) is positioned on top of the first side panel (2200), the second side panel (2300), and the second end panel (2400). After this last step (Step 5), the collapsible container (2000) is now in the collapsed position.

Figure 25B:
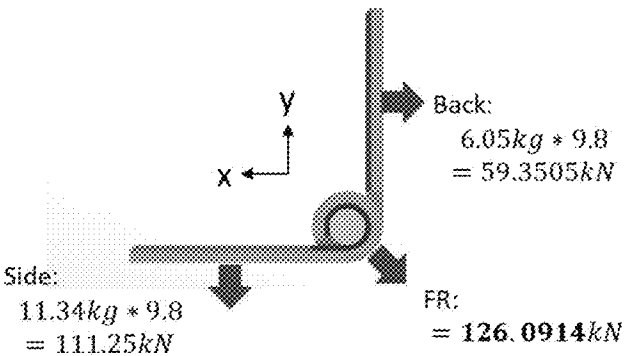
FIG. 25B illustrates a partial, top view of a calculated double shear force on the piano hinge of FIG. 25A according to an embodiment of the invention.
Figure 25C:
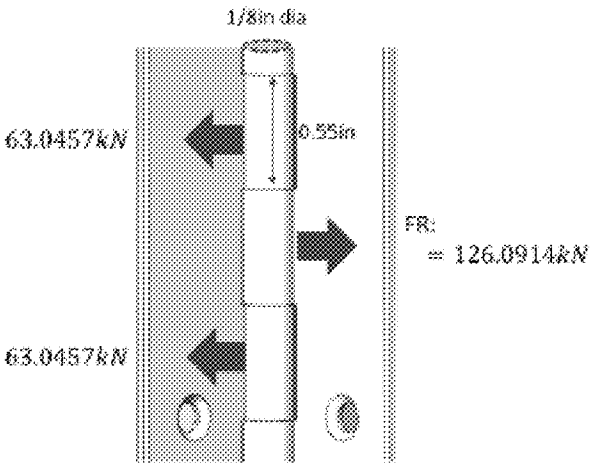
FIG. 25C illustrates a partial, front view of a calculated double shear force on the piano hinge of FIG. 25A according to an embodiment of the invention.
Figure 25A:
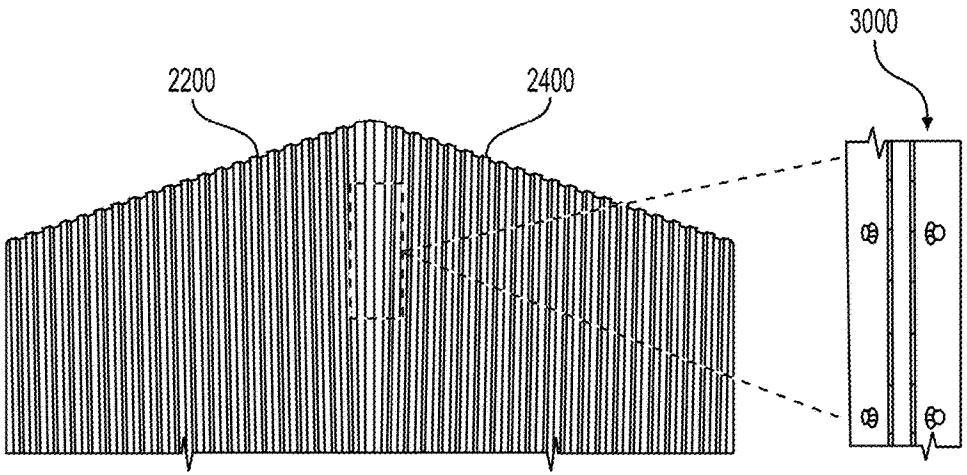
FIG. 25A illustrates a partial, side perspective view of a piano hinge installation along two panels of a collapsible container according to an embodiment of the invention.

FIG. 25A illustrates a piano hinge installation along two panels of a collapsible container according to an embodiment of the invention. As shown in FIG. 25A, a piano hinge (3000) is provided between a first side panel (2200) and a second end panel (2400) of the collapsible container (2000) of FIGS. 22 and 23. To lock the panels in the assembled or erected configuration of the container, a pin is inserted into the piano hinge (3000) to thus, interlock each top corner (which experiences the highest stresses, which was determined from FEA results, discussed in more detail below). According to one embodiment, a double shear force calculation (see, e.g., FIGS. 25B and 25C) was conducted in order to determine the shear force, i.e., standard force calculation, that is being exhibited by a pin inserted into the piano hinge (3000) that is joining the first side panel (2200) and the second end panel (2400). The piano hinge (3000) can be the most vulnerable to failure, since the piano hinge (3000) is generally one foot in length and is positioned at a topmost corner to lock the first side panel (2200) and the second end panel (2400), respectively. A pin inserted into the piano hinge (3000) may experience the highest degree of shear in the collapsible container assembly, and, thus, it was important to calculate if such a design and mounting location would be sufficient. A shear force required to shear a pin in double shear is twice the shear force required in single shear since there are two shear planes (i.e., the total shear area is doubled). However, while the shear force is doubled, the shear stress at failure will be the same in both cases since the material of the hinge does not change. For this embodiment, stainless steel hinges were used with a ⅛ inch pin diameter to calculate the double shear force on the piano hinge (3000) at a 3.5 factor of safety (see, e.g., FIGS. 25B and 25C). The results of the double shear force calculation are shown in FIGS. 25B and 25C, as well as the following Table 1, where 1 $N/mm^2$=1 MPa (megapascal).

TABLE 1

| RESULTS | |
|---|---|
| Sectional Area Pin | 7.942 $mm^2$ |
| Shear Stress Avg. Pin | 7.93 $N/mm^2$ |
| Bearing Stress Bt | 1.42 $N/mm^2$ |
| Bearing Stress Bt1 | 2.84 $N/mm^2$ |
| Allowable Stress | 144.29 $N/mm^2$ |

As shown in Table 1 above, the average shear throughout the pin was calculated to be 7.93 MPa, while the allowable stress of the hinge was 144.29 MPa. According to this calculation, the piano hinge (3000) is nowhere near failure given the forces of the weighted panels (i.e., first side panel (2200) and the second end panel (2400)) acting on the hinge when assembled in the upright or erected position. Moreover, the average shear throughout the pin was calculated to be substantially larger than the stress on either hinge or bearing. Despite this, the shear stress of the pin was well within the allowable stress of the material.

Figure 26C:
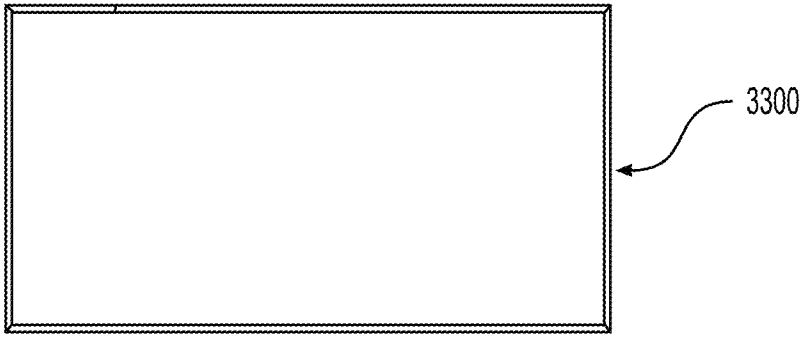
FIGS. 26A to 26C illustrate top views of hollow steel bracing provided on a bottom portion or base of a collapsible container according to an embodiment of the invention.
Figure 26B:
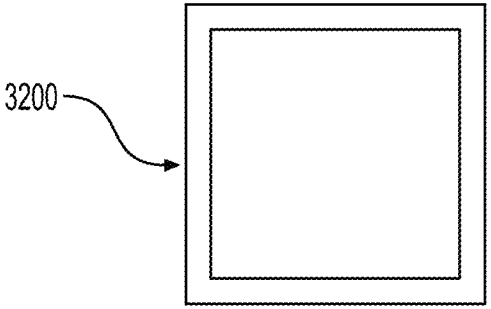
Figure 26A:
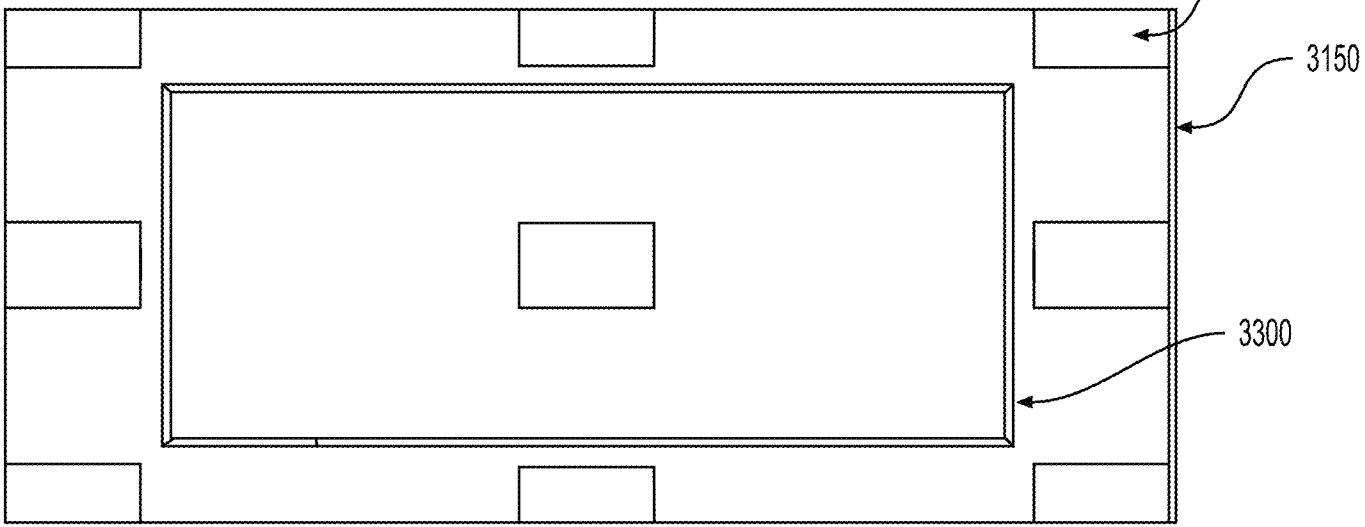

FIGS. 26A-26C illustrate top views of hollow steel bracing provided on a bottom portion of a collapsible container according to an embodiment of the invention. As shown in the embodiment of FIG. 26A, the bottom portion or base (3150) of a collapsible container is illustrated having a rectangular hollow steel bracing (3300) in the center of the base (3150), and a plurality of smaller, rectangular hollow steel bracing (3200) spaced around the edges and within the center of the base (3150). FIG. 26B illustrates the dimension and size of the smaller, rectangular hollow steel bracing (3200) that is provided around the edges and within the center of the base (3150), while FIG. 26C illustrates the dimension and size of the rectangular hollow steel bracing (3300) that is provided in the center of the base (3150) (see, e.g., FIG. 26A). According to one embodiment, this hollow steel bracing (3300, 3200) was included on the base (3150) of the collapsible container to prevent a full and assembled container from buckling when being transported by a forklift.

Figure 27B:
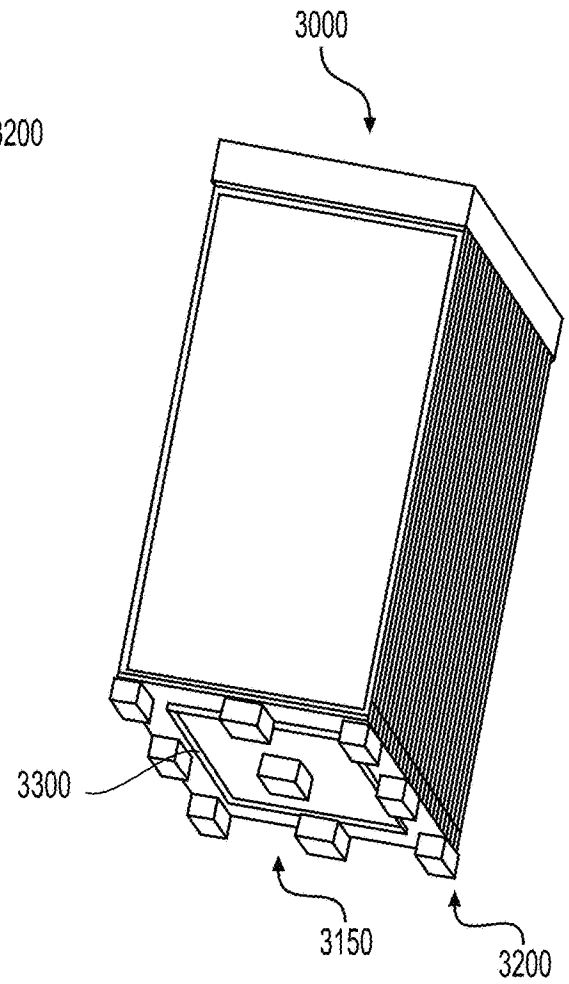
FIG. 27B illustrates a bottom perspective view of the hollow steel bracing of FIG. 27A provided on a bottom portion or base of a collapsible container according to an embodiment of the invention.
Figure 27A:
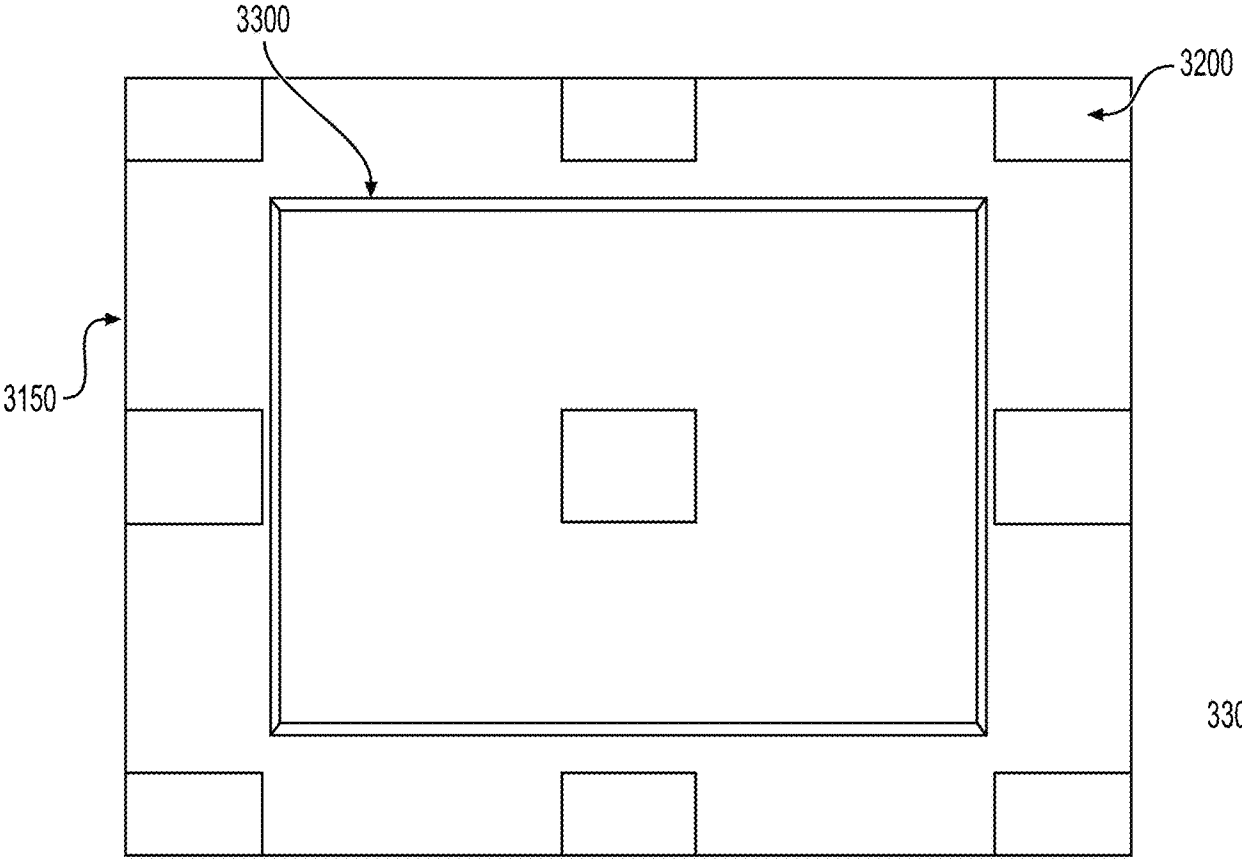
FIG. 27A illustrates a top view of the hollow steel bracing of FIGS. 26A to 26C provided on a bottom portion or base of a collapsible container according to an embodiment of the invention.

FIGS. 27A and 27B further illustrate the hollow steel bracing of FIGS. 26A to 26C provided on a bottom portion of a collapsible container according to an embodiment of the invention. Similar to FIG. 26A, the embodiment of FIG. 27A illustrates the bottom portion or base (3150) of a collapsible container having a rectangular hollow steel bracing (3300) in the center of the base (3150), and a plurality of smaller, rectangular hollow steel bracing (3200) spaced around the edges and within the center of the base (3150). FIG. 27B illustrates a collapsible container (3000) having the hollow steel bracing (3300, 3200) attached to the base (3150). According to one embodiment, this hollow steel bracing (3300, 3200) is provided or attached to the base (3150) to provide extra support or reinforcement to the collapsible container (3000). According to one embodiment, the hollow steel bracing (3300, 3200) is made out of a 0.75 inch by 0.75 inch steel tubing profile with a thickness of 0.07 inches. Thus, according to this embodiment, the hollow steel bracing (3300, 3200) is meant to reinforce the base while minimizing weight. According to one embodiment, the hollow steel bracing (3300, 3200) is 63 inches long and 33 inches wide. As discussed above, the hollow steel bracing (3300, 3200) serves as a reinforcement to the base (3150) to support the load in the collapsible container (3000). In addition, according to one embodiment, the hollow steel bracing (3300, 3200) protects the base (3150) against buckling and/or damage that may occur when the collapsible container (3000) is lifted by either a forklift or a pallet truck.

Figure 28B:
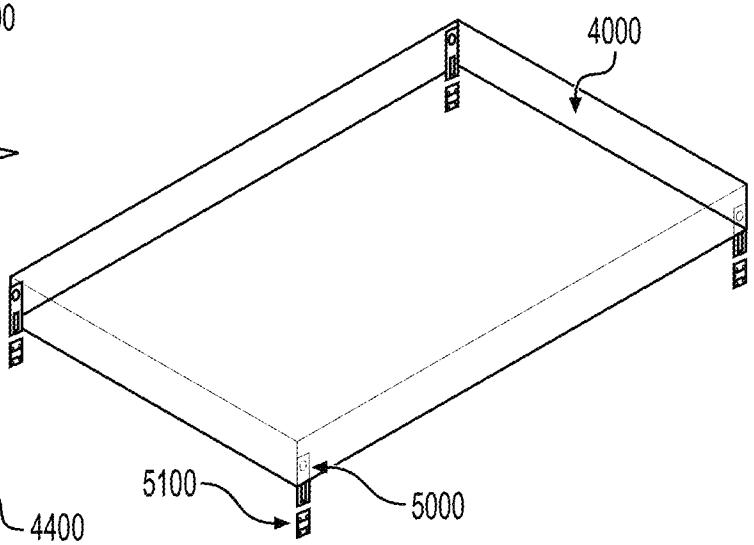
FIG. 28B illustrates a top perspective view of the latching mechanism of FIG. 28A attached to a top cover or lid of a collapsible container according to an embodiment of the invention.
Figure 28A:
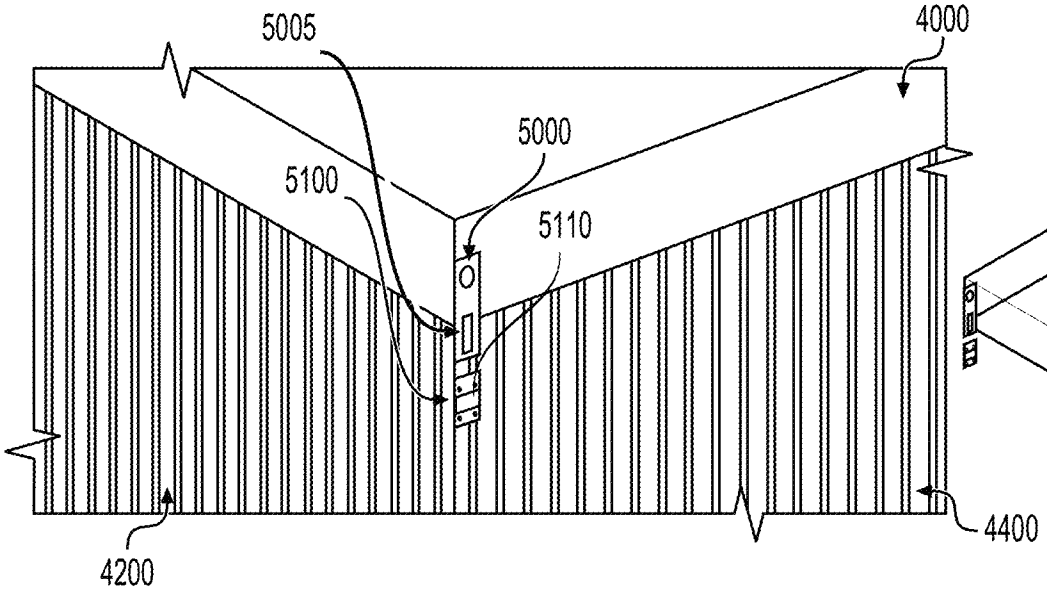
FIG. 28A illustrates a partial, exploded, top perspective view of a latching mechanism attached to a top cover or lid of a collapsible container according to an embodiment of the invention.

FIGS. 28A and 28B illustrate a latching mechanism attached to a top cover or lid of a collapsible container according to an embodiment of the invention. In particular, as shown in FIGS. 28A and 28B, the latching mechanism comprises (i) a first member (5000) that is attached to the top cover or lid (4000) of a collapsible container, and (ii) a second member (5100) that is attached to at least one of the panels (e.g., a first side panel (4200) and/or a first end panel (4400)) of the collapsible container. The first member (5000) includes an opening (5005) that engages with an extension (5110) provided on the second member (5100) in order to latch or secure the top cover (4000) to at one of the panels (e.g., a first side panel (4200) and/or a first end panel (4400)) of the collapsible container. As shown in the embodiment of FIG. 28B, at least four latching mechanisms are provided, with the first member (5000) of each latching mechanism being attached to the top cover or lid (4000) of a collapsible container.

FIG. 29 illustrates a partial view of a corrugated panel of a collapsible container according to an embodiment of the invention. As shown in FIG. 29, the corrugated panel includes a plurality of ridges (6000) that alternate with a plurality of grooves (6100), on the surface of an otherwise flat panel. The grooves (6100) increase the rigidity and strength of an assembled collapsible container, while allowing for the use of a thinner (and therefore lighter) material. According to one embodiment, the orientation of the corrugation matters, such that the orientation should be inline with forces acting on a fully assembled or erect container, which, in this case, would be gravity (i.e., along the vertical axis). According to one embodiment, the corrugation of the panels increased the factor of safety to 16 (when testing the same panel that experienced the highest amount of loading). According to one embodiment, the corrugated panel has the following dimensions: (i) a length (A, C) of each ridge (6000) is about 1.25 inches, (i) a length (B) of each groove (6100) is about 0.75 inches, (iii) a height (H) of each groove (6100) is about 0.4 inches, (iv) a thickness (T) of the corrugation is about 0.08 inches, and (v) an angle ($\alpha$) formed between the walls of the groove (6100) and the corresponding ridge (6000) is about 110 degrees. According to one embodiment, one or more of the front, back, and side panels of the collapsible container is designed with the corrugated design of FIG. 29. By manufacturing one or more of the panels of the collapsible container to have corrugation, a cost effective and sustainable approach to producing the panels is created that allows for preparing the panels from recycled sheets, as compared to a more costly injection molded approach.

According to an embodiment, one or more of the panels, the base, and/or the top cover of the collapsible container can be manufactured through 3D printing technology. According to an embodiment, one or more of the panels, the base, and/or the top cover of the collapsible container can be manufactured through conventional plastic molding methods (including, e.g., injection molding). According to an embodiment, one or more of the panels, the base, and/or the top cover of the collapsible container can be manufactured through conventional plastic molding methods using materials that can be derived from recycled waste material.

According to an embodiment, the container further comprises a means for tracking the container during transport. According to an embodiment, the means for tracking comprises a barcode, an RFID tag, a sensor, or a combination thereof. This means for tracking allows for the collapsible container (e.g., container (100) of FIG. 1) to be scanned prior to shipment/transport, such that the collapsible container can be tracked throughout its shipment/transport.

According to an embodiment, each of the hinges used for attaching the various panels to the base of the collapsible container comprise leverage standard heavy duty steel hinges.

According to an embodiment, the collapsible container is self-contained, such that the only hardware or parts necessary for assembling the collapsible container are the above-discussed hinges provided on the panels and the above-discussed internal latching mechanisms.

According to an embodiment, a water sheet or tarp can be provided around the collapsible container when in the assembled position (see, e.g., FIGS. 1 and 4) and loaded with items, in order to provide further water resiliency when the collapsible container is being shipped and/or transported during a domestic and/or international move.

EXAMPLES

Specific embodiments of the invention will now be demonstrated by reference to the following examples. It should be understood that these examples are disclosed by way of illustrating the invention and should not be taken in any way to limit the scope of the present invention.

Example 1

Figure 30:
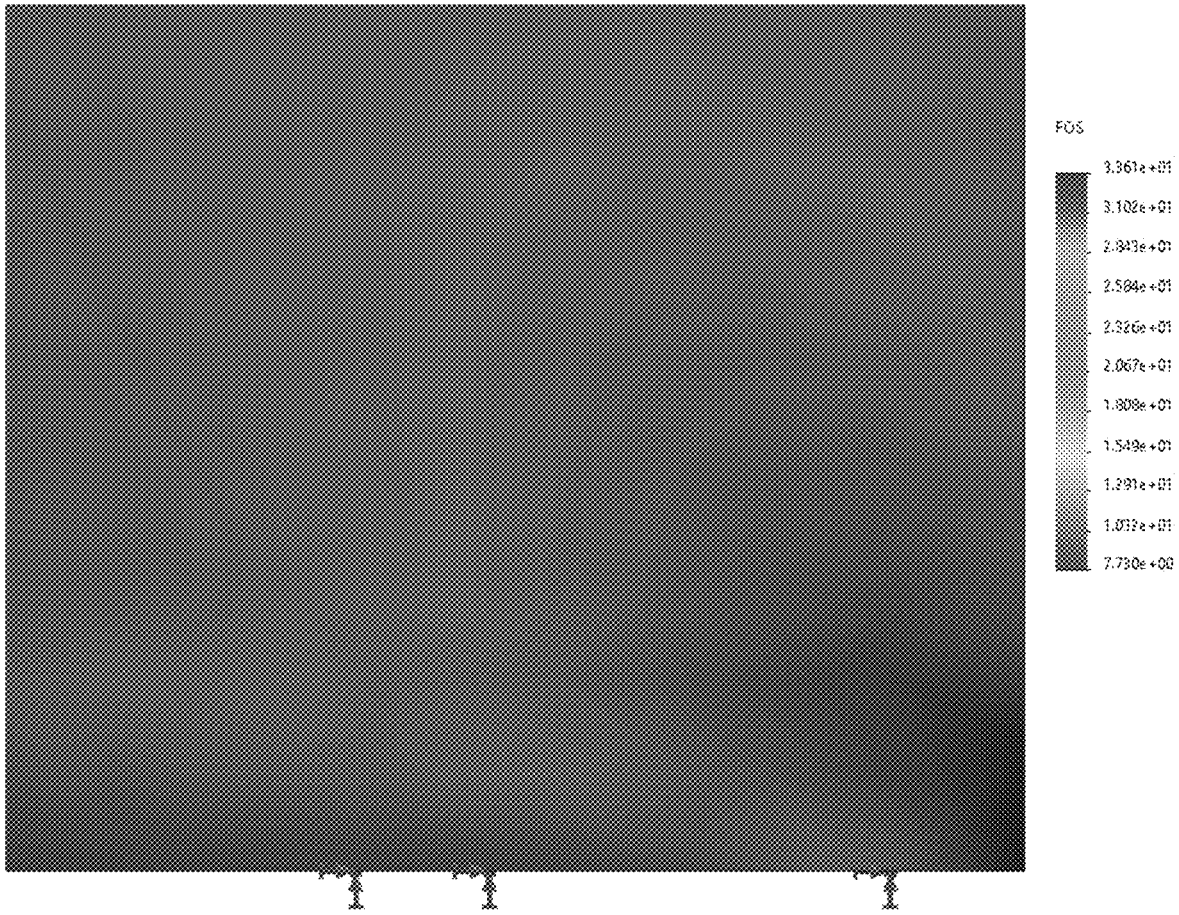
FIG. 30 illustrates an initial, flat panel finite element analysis (FEA) highlighting corner stress concentration of a collapsible container according to an embodiment of the invention.

A preliminary finite element analysis (FEA) was conducted to determine a stress concentration on the flat panel sheets (manufactured from polypropylene) of the collapsible container when in the collapsed position (see, e.g., FIGS. 6 and 20). FIG. 30 illustrates the results of this FEA, which highlights that a stress concentration occurs at the corner (e.g., the bottom left corner) of the flat panel sheets (with a 7.7 factor of safety).

Example 2

Figure 31:
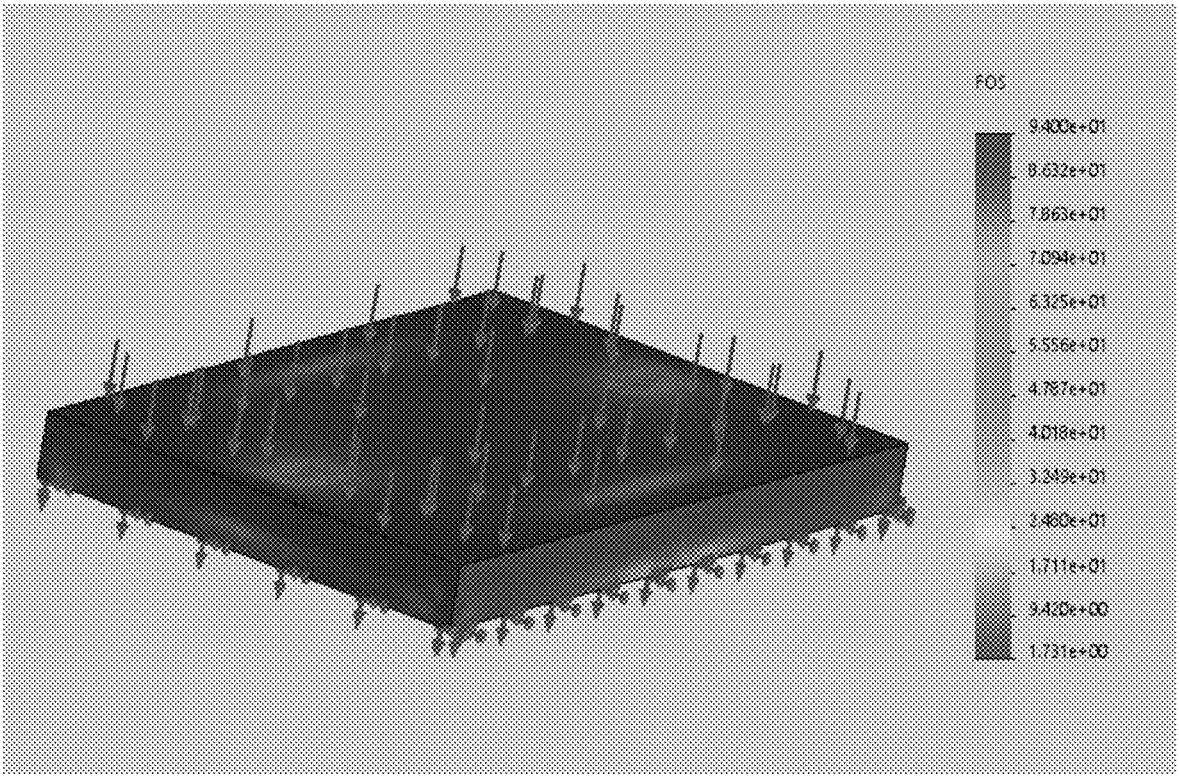
FIG. 31 illustrates factor of safety calculations of a top cover or of a collapsible container in a collapsed position experiencing the weight of six additional collapsed containers according to an embodiment of the invention.

A finite element analysis (FEA) was performed to determine the design dimensions of a top cover or lid for a collapsible container that is able to support the overall weight of six additional containers positioned on top of the lid, when in the collapsed position (see, e.g., FIG. 21B), with minimal deformation, without fracture, and with an acceptable factor of safety. In the FEA, the calculation was computed with polypropylene (PP) as the material of the lid, the lid was constrained on four ends, and the lid was subjected to a total pressure as a result of the weight of the six collapsed containers. In addition, for this FEA, the thickness of the lid was 0.2 inches, with a length of 90 inches and a width of 48 inches. FIG. 31 illustrates the results from this FEA analysis. As shown in FIG. 31, a single polypropylene lid was found to be able to support the total load of six collapsed containers with an acceptable factor of safety.

Example 3

A study was conducted to select the most suitable material for a collapsible container that is able to withstand the maximum stress that a collapsible container will be subjected to during operations, while keeping the weight of the container to a minimum. In this regard, different materials were studied to optimize the strength-to-weight ratio of the base thickness. Table 1 of FIG. 32 illustrates the properties of the different materials that were used for the analysis. In particular, as shown in Table 1 of FIG. 32, the density ($kg/m^3$), elastic modulus (GPa), and the Poisson ratio were compared for plywood, plastic (i.e., polypropylene), and a carbon fiber/epoxy composite. The elastic modulus and Poisson ratio of each material gives an indication of the stiffness and strength of the material. The density is a physical property of each material that indicates how heavy (e.g., weight) the material is. These three properties help to understand the behavior of each material with a certain geometry when subjected to stress. As shown in Table 1 of FIG. 32, the carbon fiber/epoxy composite had the highest stiffness and weight, while plywood, which had the most reduced density, was stiffer than plastic.

For each of the three materials (i.e., plywood, plastic, and the carbon fiber/epoxy composite), the dimensions/thickness of the base and the support thickness were varied, as shown in Table 2 of FIG. 32. The goal was to determine a minimum weight of the base that supports a maximum load of 2500 lbs. Table 3 of FIG. 32 illustrates the optimal results for the three materials. In particular, the carbon fiber/epoxy composite had the least deformation, while plastic had the highest deformation. The optimal base thickness for the carbon fiber/epoxy composite, plastic (polypropylene), and plywood was observed to be 0.1 inches, 0.5 inches, and 0.35 inches, respectively. From the results, the carbon fiber/epoxy composite showed the greater support for the load with reduced base thickness, deflection, and weight. Plywood had the second-best performance, with a base thickness of 0.35 inches and the most reduced weight of 62.28 lbs. This can be attributed to the high stiffness to weight ratio of plywood. Plastic had the maximum base thickness and weight that can support the maximum load. However, all three materials had a factor of safety of greater than 2, which indicates that these materials can safely support the specified maximum load of 2500 lbs. Based on this data, plastic (polypropylene) was selected for the collapsible container design due to its cost competitiveness when compared to the carbon fiber/epoxy composite and robustness when compared to plywood.

Figure 33:
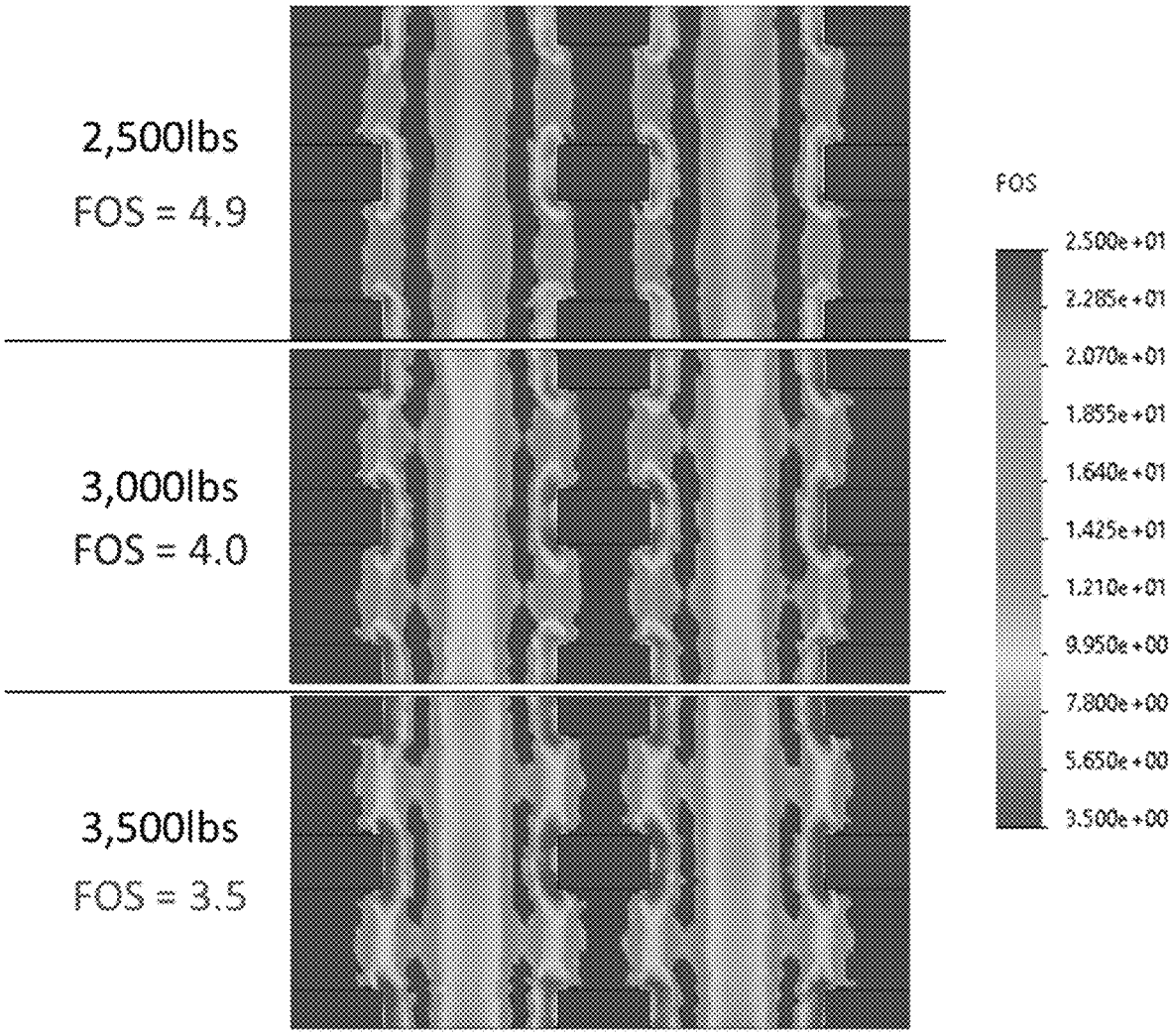
FIG. 33 illustrates an FEA of a bottom panel of a collapsible container in an assembled position that highlights the stress concentration on supports and corresponding factor of safety calculations according to an embodiment of the invention.

Once plastic (polypropylene) was selected to be the material for the collapsible container design, an PEA computation was conducted with an increased load of 3,000 lbs and 3,500 lbs., respectively. This FEA was performed to determine the structural performance of the plastic (polypropylene) base in the event that the container s overloaded during operation. FIG. 33 illustrates the results of this FEA of a plastic (polypropylene) base, which highlights stress concentration on supports and corresponding factor of safety calculations with corresponding payload on the plastic (polypropylene) base. As shown in FIG. 33, the factor of safety for a load of 3,000 lbs. and 3,500 lbs. was determined to be 4.0 and 3.5, respectively, which indicates that the plastic (polypropylene) base would not fail if the container exceeded its maximum load of 1,000 lbs.

Only exemplary embodiments of the present invention and but a few examples of its versatility are shown and described in the present disclosure. It is to be understood that the present invention is capable of use in various other combinations and environments and is capable of changes or modifications within the scope of the inventive concept as expressed herein.

Further aspects of the present disclosure are provided by the subject matter of the following clauses.

A collapsible container comprising (a) base; (b) a first side panel hingedly attached to the base; (c) a second side panel hingedly attached to the base; (d) a first end panel hingedly attached to the base, the first end panel including a door; and (e) a second end panel hingedly attached to the base, wherein the collapsible container is configured to be positioned in a collapsed position and an assembled position, and wherein, in the collapsed position, the second end panel is positioned on top of the second side panel, the second side panel is positioned on top of the first side panel, the first side panel is positioned on top of the first end panel, and the first end panel is positioned on top of the base.

The collapsible container of any preceding clause, wherein, in the assembled position, (a) the first end panel attaches to (i) the first side panel along a first side of the first end panel and (ii) the second side panel along a second side of the first end panel, and (b) the second end panel attaches to (i) the first side panel along a first side of the second end panel and (ii) the second side panel along a second side of the second end panel, such that the first end panel is disposed opposite to the second end panel and the first side panel is disposed opposite to the second side panel.

The collapsible container of any preceding clause, wherein, in the assembled position, the first end panel attaches to each of the first side panel and the second side panel using a notched design along each of the first side and the second side of the first end panel.

The collapsible container of any preceding clause, wherein, in the assembled position, the first end panel further attaches to each of the first side panel and the second side panel using an internal latching mechanism.

The collapsible container of any preceding clause, wherein the internal latching mechanism comprises a locking pin configured to be positioned within a plastic bar that is disposed on an interior surface of the first end panel.

The collapsible container of airy preceding clause, wherein, in the assembled position, the second end panel attaches to each of the first side panel and the second side panel using a notched design along each of the first side and the second side of the second end panel.

The collapsible container of any preceding clause, wherein, in the assembled position, the second end panel further attaches to each of the first side panel and the second side panel using an internal latching mechanism.

The collapsible container of any preceding clause, wherein the internal latching mechanism comprises (i) a locking pin configured to be positioned within a plastic bar that is disposed on an interior surface of the second end panel or (ii) a pin configured to be positioned within a piano hinge installed on an interior surface of at least the second end panel.

The collapsible container of any preceding clause, further comprising a top cover.

The collapsible container of any preceding clause, wherein, in the collapsed position, the top cover is positioned on top of the second end panel.

The collapsible container of any preceding clause, wherein, in the assembled position, the top cover attaches to a top edge of the first side panel and a top edge of the second side panel with an internal latching mechanism.

The collapsible container of any preceding clause, wherein the internal latching mechanism comprises a plurality of locking pins configured to be positioned within respective plastic bars disposed on an interior surface of the top cover.

The collapsible container of any preceding clause, wherein, in the collapsed position, the top cover attaches to the base with an internal latching mechanism.

The collapsible container of any preceding clause, wherein the top cover includes an arched edge configured to provide for water drainage.

The collapsible container of any preceding clause, wherein the top cover comprises a plastic material.

The collapsible container of any preceding clause, wherein the top cover comprises a corrugated plastic material.

The collapsible container of any preceding clause, wherein the top cover includes strap points configured to support straps to secure the top cover to the collapsible container.

The collapsible container of any preceding clause, wherein each of the first side panel and the second side panel includes an internal hinge mechanism along a mid-point of the respective side panel, such that each of the first side panel and the second side panel is configured to fold in half along this internal hinge mechanism.

The collapsible container of any preceding clause, herein at least one of the first side panel and the second side panel comprises a corrugated plastic material.

The collapsible container of any preceding clause, wherein each of the base, the first and second side panels, and the first and second end panels comprises a plastic material.

The collapsible container of any preceding clause, wherein one or more of the base, the first and second side panels, and the first and second end panels of the collapsible container are manufactured by at least one of (i) 3D printing technology, (ii) conventional plastic molding methods, (iii) manufacturing methods using materials that can be derived from recycled waste material or (iv) a combination of (ii), and/or (iii).

The collapsible container of any preceding clause, wherein the door is attached tot the first end panel using a hinge mechanism.

The collapsible container of any preceding clause, wherein, in the assembled position, the door is configured to be locked using a sealing mechanism.

The collapsible container of any preceding clause, wherein the container provides 240 cubic feet of interior space in the assembled position.

The collapsible container of any preceding clause, wherein, in the collapsed position, the container has dimensions of 90 inches in length, 48 inches to 57 inches in width, and 8 inches to 14 inches in height.

The collapsible container of any preceding clause, wherein, in the assembled position, the container has dimensions of 90 inches in length, 48 inches to 57 inches in width, and 84 inches to 90 inches in height.

The collapsible container of any preceding clause, wherein the container only comprises plastic and metal parts.

The collapsible container of any preceding clause, wherein the container is only assembled with a plurality of hinges and a plurality of latching mechanisms.

The collapsible container of any preceding clause, wherein the container does not require any spare parts, bolts, nails, screws or other attaching means.

The collapsible container of any preceding clause, wherein the container is water resistant.

The collapsible container of any preceding clause, wherein the container further comprises a means for tracking the container during transport.

The collapsible container of any preceding clause, wherein the means for tracking comprises a barcode, an RED tag, a sensor, or a combination thereof.

The collapsible container of any preceding clause, wherein at least one of the first side panel, the second side panel, the first end panel, and the second end panel includes an internal pin configured to hold the respective panel in an upright position.

A method of assembling a collapsible container comprising (a) providing a collapsible container that includes (i) a base; (ii) a first side panel hingedly attached to the base; (iii) a second side panel hingedly attached to the base; (iv) a first end panel hingedly attached to the base; and (v) a second end panel hingedly attached to the base; (b) lifting the second end panel to an upright position; (c) lifting the second side panel to an upright position; (d) attaching the second side panel to the second end panel; (e) lifting the first side panel to an upright position; (f) attaching the first side panel to the second end panel; (g) lifting the first end panel to an upright position; and (h) attaching the first end panel to both the first side panel and the second side panel.

The method of any preceding clause, wherein the first end panel attaches to each of the first side panel and the second side panel using a notched design along each of a first side and a second side of the first end panel.

The method of any preceding clause, wherein the first end panel further attaches to each of the first side panel and the second side panel using an internal latching mechanism.

The method of any preceding clause, wherein the second end panel attaches to each of the first side panel and the second side panel using a notched design along each of a first side and a second side of the second end panel.

The method of any preceding clause, wherein the second end panel further attaches to each of the first side panel and the second side panel using an internal latching mechanism.

The method of any preceding clause, further comprising positioning a top cover on top of each of the first end panel, the second end panel, the first side panel, and the second side panel.

The method of any preceding clause, wherein the top cover attaches to a top edge of the first side panel and a top edge of the second side panel with an internal latching mechanism.

A method of collapsing a collapsible container comprising (a) providing a collapsible container that includes (i) a base; (ii) a first side panel hingedly attached to the base and positioned in an upright position; (iii) a second side panel hingedly attached to the base and positioned in an upright position; (iv) a first end panel hingedly attached to the base and positioned in an upright position; and (v) a second end panel hingedly attached to the base and positioned in an upright position; (b) folding the first end panel down, such that the first end panel is positioned on top of the base; (c) folding the first side panel down, such that the first side panel is positioned on top of the first end panel; (d) folding the second side panel down, such that the second side panel is positioned on top of the first side panel; and (e) folding the second end panel down, such that the second end panel is positioned on top of the second side panel.

The method of any preceding clause, wherein the step of folding the first side panel down includes (a) folding the first side panel in half along a hinged mechanism provided along a mid-point of the first side panel, and (b) folding the first side panel down along a hinged mechanism provided at the base.

The method of any preceding clause, wherein the step of folding the second side panel down includes (a) folding the second side panel in half along a hinged mechanism provided along a mid-point of the second side panel, and (b) folding the second side panel down along a hinged mechanism provided at the base.

The method of any preceding clause, further comprising a step of removing a top cover from each of the first end panel, the second end panel, the first side panel, and the second side panel that are each positioned in the upright position.

The method of any preceding clause, further comprising positioning the top cover onto the collapsible container when in a collapsed position.

The method of any preceding clause, further comprising attaching the top cover to the base with an internal latching mechanism.

Although the foregoing description is directed to the preferred embodiments of the invention, it is noted that other variations and modifications be apparent to those skilled in the art, and may be made without departing from the spirit or scope of the invention. Moreover, features described in connection with one embodiment of the invention may be used in conjunction with other embodiments, even if not explicitly stated above.

The invention claimed is:

1. A water resistant collapsible container comprising:

a) a base comprising a non-corrugated plastic material;

b) a first side panel hingedly attached to the base;

c) a second side panel hingedly attached to the base, wherein the first and second side panels comprise a corrugated plastic material;

d) a first end panel hingedly attached to the base, the first end panel including a door;

e) a second end panel hingedly attached to the base, wherein the first and second end panels comprise a plastic material; and f) a top cover that is removably attached to each of the first side panel, the second side panel, the first end panel, and the second end panel, wherein the top cover comprises a plastic material and includes an arched edge configured to provide for water drainage, wherein each of the base, the first and second side panels, the first and second end panels, and the top cover comprises a plastic material to provide a water resistant collapsible container, wherein the non-corrugated plastic material of the base is a heavier gauge than the corrugated plastic material of the first and second side panels, wherein the collapsible container is configured to be positioned in a collapsed position and an assembled position, and wherein, in the collapsed position, the top cover is positioned on top of the second end panel, the second end panel is positioned on top of the second side panel, the second side panel is positioned on top of the first side panel, the first side panel is positioned on top of the first end panel, and the first end panel is positioned on top of the base.

2. The collapsible container according to claim 1, wherein, in the assembled position, (a) the first end panel attaches to (i) the first side panel along a first side of the first end panel and (ii) the second side panel along a second side of the first end panel, and (b) the second end panel attaches to (i) the first side panel along a first side of the second end panel and (ii) the second side panel along a second side of the second end panel, such that the first end panel is disposed opposite to the second end panel and the first side panel is disposed opposite to the second side panel.

3. The collapsible container according to claim 2, wherein, in the assembled position, the first end panel attaches to each of the first side panel and the second side panel using a notched design along each of the first side and the second side of the first end panel.

4. The collapsible container according to claim 3, wherein, in the assembled position, the first end panel further attaches to each of the first side panel and the second side panel using an internal latching mechanism.

5. The collapsible container according to claim 4, wherein the internal latching mechanism comprises a locking pin configured to be positioned within a plastic bar that is disposed on an interior surface of the first end panel.

6. The collapsible container according to claim 2, wherein, in the assembled position, the second end panel attaches to each of the first side panel and the second side panel using a notched design along each of the first side and the second side of the second end panel.

7. The collapsible container according to claim 6, wherein, in the assembled position, the second end panel further attaches to each of the first side panel and the second side panel using an internal latching mechanism.

8. The collapsible container according to claim 7, wherein the internal latching mechanism comprises (i) a locking pin configured to be positioned within a plastic bar that is disposed on an interior surface of the second end panel or (ii) a pin configured to be positioned within a piano hinge installed on an interior surface of at least the second end panel.

9. The collapsible container according to claim 1, wherein, in the assembled position, the top cover attaches to a top edge of the first side panel and a top edge of the second side panel with an internal latching mechanism.

10. The collapsible container according to claim 9, wherein the internal latching mechanism comprises a plurality of locking pins configured to be positioned within respective plastic bars disposed on an interior surface of the top cover.

11. The collapsible container according to claim 1, wherein, in the collapsed position, the top cover attaches to the base with an internal latching mechanism.

12. The collapsible container according to claim 1, wherein the top cover includes strap points configured to support straps to secure the top cover to the collapsible container.

13. The collapsible container according to claim 1, wherein each of the first side panel and the second side panel includes an internal hinge mechanism along a mid-point of the respective side panel, such that each of the first side panel and the second side panel is configured to fold in half along this internal hinge mechanism.

14. The collapsible container according to claim 1, wherein one or more of the base, the first and second side panels, and the first and second end panels of the collapsible container are manufactured by at least one of (i) 3D printing technology, (ii) plastic molding methods, (iii) manufacturing methods using materials that can be derived from recycled waste material, or (iv) a combination of (i), (ii), and/or (iii).

15. The collapsible container according to claim 1, wherein the door is attached to the first end panel using a hinge mechanism.

16. The collapsible container according to claim 1, wherein, in the assembled position, the door is configured to be locked using a sealing mechanism.

17. The collapsible container according to claim 1, wherein the container provides 240 cubic feet of interior space in the assembled position.

18. The collapsible container according to claim 1, wherein, in the collapsed position, the container has dimensions of 90 inches in length, 48 inches to 57 inches in width, and 8 inches to 14 inches in height.

19. The collapsible container according to claim 1, wherein, in the assembled position, the container has dimensions of 90 inches in length, 48 inches to 57 inches in width, and 84 inches to 90 inches in height.

20. The collapsible container according to claim 1, wherein the container only comprises plastic and metal parts.

21. The collapsible container according to claim 1, wherein, in the assembled position, each of the first side panel, the second side panel, the first end panel, and the second end panel of the container is only attached to the base or another panel with at least one of a plurality of hinges or a plurality of latching mechanisms.

22. The collapsible container according to claim 21, wherein the container does not require any spare parts, bolts, nails, screws or other attaching means.

23. The collapsible container according to claim 1, wherein the container further comprises a means for tracking the container during transport.

24. The collapsible container according to claim 23, wherein the means for tracking comprises a barcode, an RFID tag, a sensor, or a combination thereof.

25. The collapsible container according to claim 1, wherein at least one of the first side panel, the second side panel, the first end panel, and the second end panel includes an internal pin configured to hold the respective panel in an upright position.

26. A method of assembling a water resistant collapsible container comprising:

a) providing a collapsible container that includes:
   i) a base comprising a non-corrugated plastic material;
   ii) a first side panel hingedly attached to the base;
   iii) a second side panel hingedly attached to the base, wherein the first and second side panels comprise a corrugated plastic material;
   iv) a first end panel hingedly attached to the base;
   v) a second end panel hingedly attached to the base, wherein the first and second end panels comprise a plastic material; and
   vi) a top cover that is configured to be removably attached to each of the first side panel, the second side panel, the first end panel, and the second end panel, wherein the top cover comprises a plastic material and includes an arched edge configured to provide for water drainage;
b) lifting the second end panel to an upright position;
c) lifting the second side panel to an upright position;
d) attaching the second side panel to the second end panel;
e) lifting the first side panel to an upright position;
f) attaching the first side panel to the second end panel;
g) lifting the first end panel to an upright position;
h) attaching the first end panel to both the first side panel and the second side panel; and
i) positioning and attaching the top cover on top of each of the first side panel, the second side panel, the first end panel, and the second end panel, wherein each of the base, the first and second side panels, the first and second end panels, and the top cover comprises a plastic material to provide a water resistant collapsible container, and wherein the non-corrugated plastic material of the base is a heavier gauge than the corrugated plastic material of the first and second side panels.

27. The method according to claim 26, wherein the first end panel attaches to each of the first side panel and the second side panel using a notched design along each of a first side and a second side of the first end panel.

28. The method according to claim 27, wherein the first end panel further attaches to each of the first side panel and the second side panel using an internal latching mechanism.

29. The method according to claim 26, wherein the second end panel attaches to each of the first side panel and the second side panel using a notched design along each of a first side and a second side of the second end panel.

30. The method according to claim 29, wherein the second end panel further attaches to each of the first side panel and the second side panel using an internal latching mechanism.

31. The method according to claim 26, wherein the top cover attaches to a top edge of the first side panel and a top edge of the second side panel with an internal latching mechanism.

32. A method of collapsing a water resistant collapsible container comprising:

a) providing a collapsible container that includes:
   i) a base comprising a non-corrugated plastic material;
   ii) a first side panel hingedly attached to the base and positioned in an upright position;
   iii) a second side panel hingedly attached to the base and positioned in an upright position, wherein the first and second side panels comprise a corrugated plastic material;
   iv) a first end panel hingedly attached to the base and positioned in an upright position;
   v) a second end panel hingedly attached to the base and positioned in an upright position, wherein the first and second end panels comprise a plastic material; and
   vi) a top cover that is configured to be removably attached to each of the first side panel, the second side panel, the first end panel, and the second end panel, wherein the top cover comprises a plastic material and includes an arched edge configured to provide for water drainage;

b) removing the top cover from each of the first end panel, the second end panel, the first side panel, and the second side panel that are each positioned in the upright position;

c) folding the first end panel down, such that the first end panel is positioned on top of the base;

d) folding the first side panel down, such that the first side panel is positioned on top of the first end panel;

e) folding the second side panel down, such that the second side panel is positioned on top of the first side panel; and f) folding the second end panel down, such that the second end panel is positioned on top of the second side panel, wherein each of the base, the first and second side panels, the first and second end panels, and the top cover comprises a plastic material to provide a water resistant collapsible container, and wherein the non-corrugated plastic material of the base is a heavier gauge than the corrugated plastic material of the first and second side panels.

33. The method according to claim 32, wherein the step of folding the first side panel down includes (a) folding the first side panel in half along a hinged mechanism provided along a mid-point of the first side panel, and (b) folding the first side panel down along a hinged mechanism provided at the base.

34. The method according to claim 32, wherein the step of folding the second side panel down includes (a) folding the second side panel in half along a hinged mechanism provided along a mid-point of the second side panel, and (b) folding the second side panel down along a hinged mechanism provided at the base.

35. The method according to claim 32, further comprising positioning the top cover onto the collapsible container when in a collapsed position.

36. The method according to claim 35, further comprising attaching the top cover to the base with an internal latching mechanism.

37. A variable strength collapsible container comprising:

a) a base comprising a non-corrugated plastic material;

b) a first side panel hingedly attached to the base;

c) a second side panel hingedly attached to the base, wherein the first and second side panels comprise a corrugated plastic material;

d) a first end panel hingedly attached to the base, the first end panel including a door;

e) a second end panel hingedly attached to the base, wherein the first and second end panels comprise a plastic material; and f) a top cover that is removably attached to each of the first side panel, the second side panel, the first end panel, and the second end panel, wherein the top cover comprises a plastic material and includes strap points configured to support straps to secure the top cover to the collapsible container, wherein each of the non-corrugated plastic material of the base and the strap points of the top cover is a heavier gauge plastic material than the corrugated plastic material of the first and second side panels to provide an added strength to the collapsible container, wherein the collapsible container is configured to be positioned in a collapsed position and an assembled position, and wherein, in the collapsed position, the top cover is positioned on top of the second end panel, the second end panel is positioned on top of the second side panel, the second side panel is positioned on top of the first side panel, the first side panel is positioned on top of the first end panel, and the first end panel is positioned on top of the base.

* * * * *